US007663578B2

(12) United States Patent
Miyake

(10) Patent No.: US 7,663,578 B2
(45) Date of Patent: Feb. 16, 2010

(54) SEMICONDUCTOR DEVICE, DISPLAY DEVICE AND ELECTRONIC DEVICE

(75) Inventor: Hiroyuki Miyake, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 552 days.

(21) Appl. No.: 11/620,345

(22) Filed: Jan. 5, 2007

(65) Prior Publication Data

US 2007/0159417 A1 Jul. 12, 2007

(30) Foreign Application Priority Data

Jan. 7, 2006 (JP) ..... 2006-001929

(51) Int. Cl.
*G09G 5/00* (2006.01)

(52) U.S. Cl. ..... 345/76; 345/82; 315/169.3

(58) Field of Classification Search ..... 345/36, 345/39, 48, 76, 82, 84; 315/169.3
See application file for complete search history.

(56) References Cited

U.S. PATENT DOCUMENTS

| | | | | |
|---|---|---|---|---|
| 5,712,652 | A | 1/1998 | Sato et al. | |
| 5,798,746 | A | 8/1998 | Koyama | |
| 6,693,388 | B2 * | 2/2004 | Oomura | 315/169.3 |
| 6,730,966 | B2 | 5/2004 | Koyama | |
| 6,765,549 | B1 | 7/2004 | Yamazaki et al. | |
| 6,774,876 | B2 | 8/2004 | Inukai | |
| 6,975,298 | B2 | 12/2005 | Koyama et al. | |
| 6,982,462 | B2 | 1/2006 | Koyama | |
| 7,088,322 | B2 | 8/2006 | Koyama et al. | |
| 7,113,154 | B1 | 9/2006 | Inukai | |
| 7,151,511 | B2 | 12/2006 | Koyama | |
| 2002/0024508 | A1 | 2/2002 | Nakamura et al. | |

(Continued)

FOREIGN PATENT DOCUMENTS

EP 1 103 946 A2 5/2001

(Continued)

OTHER PUBLICATIONS

JP 2001-343933—English abstract provided by esp@cenet Worldwide (2006) and family to U.S. Patent No. 7,113,154 (Desig. ID "AH") and European Patent Publication No. 1 103 946 (Desig. ID "AR").

(Continued)

*Primary Examiner*—Richard Hjerpe
*Assistant Examiner*—Sahlu Okebato
(74) *Attorney, Agent, or Firm*—Fish & Richardson P.C.

(57) ABSTRACT

A potential which is applied to a gate electrode of a driving transistor in accordance with an emission state or a non-emission state of a light-emitting element fluctuates due to noise or leakage from a selection transistor, or the like, which causes a problem in that the driving transistor cannot turn on or off normally and malfunctions. The present invention includes a transistor connected to a light-emitting element, a power source line, a scan line, a memory circuit, and a switching circuit, in which the transistor controls light emission or non light emission of the light-emitting element, and the switching circuit controlled by the scan line conducts switching between the transistor, and the memory circuit and the power source line, and applies an input potential to the transistor.

22 Claims, 16 Drawing Sheets

U.S. PATENT DOCUMENTS

| | | | | |
|---|---|---|---|---|
| 2002/0036604 | A1 | 3/2002 | Yamazaki et al. | |
| 2003/0063078 | A1 | 4/2003 | Hanari et al. | |
| 2004/0051684 | A1 * | 3/2004 | Ishizuka | 345/76 |
| 2004/0066358 | A1 | 4/2004 | Numao | |
| 2005/0285823 | A1 | 12/2005 | Kimura et al. | |
| 2006/0033161 | A1 | 2/2006 | Koyama | |
| 2006/0214891 | A1 | 9/2006 | Hanari et al. | |
| 2006/0244689 | A1 | 11/2006 | Osame et al. | |

FOREIGN PATENT DOCUMENTS

| | | | |
|---|---|---|---|
| EP | 1 182 636 | A2 | 2/2002 |
| JP | 2001-343933 | | 12/2001 |
| JP | 2002-140034 | | 5/2002 |
| JP | 2004-163601 | | 6/2004 |
| JP | 2005-049402 | | 2/2005 |

OTHER PUBLICATIONS

JP 2002-140034—English abstract provided by esp@cenet Worldwide (2006) and family to U.S. Patent Application Publication No. 2002/036604 (Desig. ID "AJ") and European Patent Publication No. 1 182 636 (Desig. IS "AS").

JP 2004-163601—English abstract provided by esp@cenet Worldwide (2006).

JP 2005-049402—English abstract provided by esp@cenet Worldwide (2006).

European Search Report (European Patent Application No. 07000045.0) dated Sep. 8, 2009, 8 pages.

* cited by examiner

SEMICONDUCTOR DEVICE, DISPLAY DEVICE AND ELECTRONIC DEVICE

BACKGROUND OF THE INVENTION

1. Field of the Invention

The present invention relates to semiconductor devices. In particular, the present invention relates to semiconductor devices using transistors. Further, the present invention relates to display devices including the semiconductor devices, and electronic devices including the display devices.

Note that the term "semiconductor device" here includes general devices which can function by utilizing a semiconductive property.

2. Description of the Related Art

In recent years, self-luminous display devices having pixels formed with a light-emitting element such as a light-emitting diode (LED) are drawing attention. As examples of such light-emitting elements used in such self-luminous display devices, organic light-emitting diodes (also referred to as OLED (Organic Light-Emitting Diode), organic EL elements, and electroluminescence elements (also referred to as EL elements, or the like), have been drawing attention and used for EL displays or the like. Since light-emitting elements such as OLED are self-luminous type, various advantages can be provided such that high visually of pixels is ensured as compared to liquid crystal displays, no back light is required, and high response speed is achieved.

A self-luminous display device includes a display and a peripheral circuit for inputting signals to the display. By disposing a light-emitting element in each pixel of the display and controlling emission of each light-emitting element, images are displayed.

In each pixel of the display, a thin film transistor (hereinafter referred to as a TFT) is disposed. Here, a pixel configuration is described, in which two TFTs are disposed in each pixel in order to control emission of a light-emitting element in each pixel (for example, Reference 1: Japanese Published Patent Application No 2001-343933).

FIG. 15 shows a pixel configuration of a display. In a pixel portion 2100, data lines (also referred to as source signal lines) S1 to Sx, scan lines (also referred to as gate signal lines) G1 to Gy, and power source lines (also referred to as power supply lines) V1 to Vx are disposed. In addition, pixels of x (x is a natural number) columns and y (y is a natural number) rows are disposed. Each pixel includes a selection transistor (also referred to as a switching TFT, a switch transistor or a SWTFT) 2101, a driving transistor (also referred to as a driving T11) 2102, a storage capacitor 2103, and a light-emitting element 2104.

A driving method of the pixel portion 2100 is described briefly. When a scan line is selected in a selection period, the selection transistor 2101 is turned on and a potential of a data line at the time is written into a gate terminal of the driving transistor 2102 through the selection transistor 2101. In the period from termination of the selection period and to the next selection period, a potential of the gate terminal of the driving transistor 2102 is held in the storage capacitor 2103.

In the configuration of FIG. 15, when the relationship between the absolute value of a voltage between a gate and a source (|Vgs|) of the driving transistor and a threshold voltage (|Vth|) of the driving transistor 2102 satisfies |Vgs|>|Vth|, the driving transistor 2102 is turned on and a current flows by a voltage between the power source line and a counter electrode connected to the light-emitting element 2104, thereby allowing the light-emitting element 2104 to be in the emission state. Meanwhile, when |Vgs|=|Vth| is satisfied, the driving transistor 2102 is turned off and no voltage is applied to the opposite sides of the light-emitting element 2104, thereby making the light-emitting element 2104 emit no light (non-emission state).

In the pixel having the configuration of FIG. 15, two types of driving methods are generally used for expressing gray scales, which are an analog gray scale method and a digital gray scale method.

The analog gray scale method is a method for expressing gray scales by changing the luminance of a light-emitting element, using an analog signal as a signal input to each pixel. On the other hand, the digital gray scale method is a method for expressing gray scales by controlling emission or non-emission of a light-emitting element only by controlling on or off of a switching element with a signal input to each pixel.

In comparison with the analog gray scale method, the digital gray scale method is advantageous in that it is difficult to be affected by characteristic variation between TFTs, and thus gray scales can be expressed more accurately.

As an example of the digital gray scale method for expressing gray scales, there is a time gray scale method. In the time gray scale method, gray scales are expressed by controlling the emission period of each pixel of a display device. Further, by using an erasing transistor (also referred to as an erasing TFT) in addition to the driving transistor and the selection transistor in each pixel in the digital time gray scale method as disclosed in Reference 1, multi-gray scale display with high resolution can be achieved. In this specification, such a driving method is called an SES (Simultaneous Erasing Scan) drive.

In addition, in recent years, a display device having such a pixel configuration in which a memory is incorporated in each pixel of a display portion in order to reduce power consumption of the display device has been known (see Reference 2: Japanese Published Patent Application No. 2002-140034 and Reference 3: Japanese Published Patent Application No 2005-049402).

In a conventional pixel configuration disclosed in Reference 1, the power consumption of a data line driver circuit greatly depends on the charging and discharging of the last buffer. The power consumption P is generally calculated by using the following Formula (1), where F is frequency, C is capacitance, and V is voltage.

$$P=FCV^2 \text{ (F: Frequency, C: Capacitance, and V: Voltage)} \quad (1)$$

According to the Formula (1), it can be seen that the voltage of a data line is preferably set to have as a small amplitude as possible by the data line driver circuit. Therefore, the voltage of a data line is set to have the minimum amplitude which allows on or off operation of the driving transistor. In other words, the absolute value of a voltage between a gate and a source (hereinafter referred to as Vgs) of the driving transistor is preferably so as to surely control the on or off operation of the driving transistor.

A potential of a data line to be input into a pixel is held in a storage capacitor in during period from termination of the selection period for turning on the selection transistor and to the next selection period for turning on the selection transistor.

However, there is such a problem that a potential that has been accumulated in the storage capacitor to be applied to the gate terminal of the driving transistor may fluctuate due to noise, leakage from the selection transistor or the like, and thus the driving transistor may malfunction without being capable of keeping the normal on or off state.

In addition, there is another problem in that the power consumption is increased if the voltage amplitude of the data line is increased in order to prevent malfunctions of the driving transistor that would be caused by fluctuation of a gate potential of the driving transistor. It can be seen from Formula (1) that the power consumption of a data line driver circuit increases in proportion to the square of a voltage; therefore, an increase in the voltage amplitude of a data line influences on the power consumption greatly.

More concretely, with reference to FIGS. 16A and 16B, problems of the conventional technique are described in detail. In the pixel configuration shown in FIG. 16A, a pixel 2200 includes a selection transistor 2201, a driving transistor 2202, a storage capacitor 2203, and a light-emitting element 2204. Note that the light-emitting element is driven with digital signals. In addition, the selection transistor is an N-channel transistor and the driving transistor is a P-channel transistor A potential value of each wiring in FIG. 16A is described specifically. A potential of a counter electrode 2208 of the light-emitting element 2204 is GND (hereinafter, 0 V), a potential of a power source line 2207 is 7 V, a high potential level (hereinafter indicated as an High level, an High potential or High) of a data line 2206 is 7 V, a low potential level (hereinafter indicated as an Low level, an Low potential or Low) of the data line 2206 is 0 V, an High potential of a scan line 2205 is 10 V, and an Low potential of the scan line 2205 is 0 V.

Needless to say, a potential of each wiring, a polarity of each transistor and the like are just examples, and therefore, the present invention is not limited to these examples.

FIG. 16B shows a timing chart of potentials at the scan line, the data line and the node G when the light-emitting element is in the emission or non-emission state. In the period when the scan line 2205 is at 10 V, the selection transistor 2201 is turned on, and the node G receives a potential of the data line 2206. Thus, the potential of the data line 2206 is held in the storage capacitor 2203. If the potential held in the storage capacitor 2203 is the High potential, namely 7 V or higher, the voltage between the gate and source of the driving transistor 2202 becomes lower than the absolute value of the threshold voltage of the driving transistor 2202, thereby turning the driving transistor 2202 off to allow the light-emitting element 2204 to be in the non-emission state. If the potential held in the storage capacitor 2203 is the Low potential, namely 0 V or lower, the voltage between the gate and source of the driving transistor 2202 becomes higher than the absolute value of the threshold voltage of the driving transistor 2202, thereby turning the driving transistor 2202 on to allow the light-emitting element 2204 to be in the emission state.

In the pixel configuration shown herein, a potential of the data line 2206 is directly written into the node G Since the potential of the node G that is supplied from the data line 2206 controls on or off of the driving transistor 2202, at least the High potential of the data line 2206 should be equal to or higher than the potential of the power source line 2207, while the Low potential of the data line 2206 should be sufficient to turn on the driving transistor 2202. In other words, the relationship between the voltage (Vel) applied to the light-emitting element 2204 and the voltage between the source and the drain (Vds) of the driving transistor 2202 should satisfy a condition to become Vel>>Vds, which can operate the driving transistor 2202 in the linear region.

However, there is such a possibility that the potential of the node G may fluctuate due to variations or fluctuations of the threshold voltage of the driving transistor 2202, noise from outside during a holding period, a leakage potential from the selection transistor 2201 as shown in FIG. 16B, or the like, in which case the voltage between the gate and source of the driving transistor 2202 fluctuates, and thus the driving transistor 2202 may malfunction without being capable of keeping the normal on or off state.

Thus, a semiconductor device having a conventional pixel configuration has a problem in that a potential applied to the gate terminal of the driving transistor fluctuates due to noise or a leakage from the selection transistor, which causes the driving transistor to malfunction. Further, even if a signal having a large potential amplitude is supplied from a data line, which is enough to ensure the stable operation of the driving transistor, there arises another problem in that the power consumption of a data line driver circuit is increased.

SUMMARY OF THE INVENTION

The invention is made in view of the foregoing problems, and the invention provides a semiconductor device, a display device including the semiconductor device and an electronic device including the display device in order to overcome the foregoing problems.

One feature of the present invention is a semiconductor device including a first transistor of which a gate terminal is connected to a data line and a first terminal is connected to a first power source line; a second transistor of which a gate terminal is connected to a first scan line and a first terminal is connected to a second terminal of the first transistor; a memory circuit; a switching circuit; and a third transistor of which a gate terminal is connected to the switching circuit and a second terminal is connected to a light-emitting element, wherein the memory circuit is connected to a second terminal of the second transistor and a second scan line; wherein the switching circuit is connected to the second terminal of the second transistor, the memory circuit, and a third scan line; and wherein the switching circuit conducts switching between the third transistor, and the memory circuit and the second power source line, and applies an input potential to the gate terminal of the third transistor.

In the present invention, the first and second transistors may be N-channel transistors and the third transistor may be a P-channel transistor.

One feature of the present invention is a semiconductor device including a first N-channel transistor of which a gate terminal is connected to a data line and a first terminal is connected to a first power source line; a second N-channel transistor of which a gate terminal is connected to a first scan line and a first terminal is connected to a second terminal of the first N-channel transistor; a memory circuit; a switching circuit; and a first P-channel transistor of which a first terminal is connected to a second power source line and a second terminal is connected to a light-emitting element, the memory circuit including a NOR circuit of which a first input terminal is connected to a second terminal of the second N-channel transistor and a second input terminal is connected to a second scan line; a third N-channel transistor of which a gate terminal is connected to an output terminal of the NOR circuit and a first terminal is connected to the first power source line; a second P-channel transistor of which a gate terminal is connected to the first scan line and a first terminal is connected to the second power source line; and a third P-channel transistor of which a gate terminal is connected to the output terminal of the NOR circuit, a first terminal is connected to a second terminal of the second P-channel transistor, and a second terminal is connected to a second terminal of the third N-channel transistor; the switching circuit including a fourth N-channel transistor of which a gate terminal is connected to a third scan line, a first terminal is connected to the second terminal of the second N-channel transistor, the second terminal of the third N-channel transistor, and the second terminal of the third P-channel transistor, and a second terminal is connected to a gate terminal of the first P-channel transistor; and a fourth P-channel transistor of which a gate terminal is connected to the third scan line, a first terminal is connected to the second power source line, and a second terminal is connected to the second terminal of the fourth N-channel transistor and the gate terminal of the first P-channel transistor; wherein a first potential for turning on the first P-channel transistor or a second potential for turning off the first P-channel transistor is input to the memory circuit, wherein a third potential for turning off the first P-channel transistor is input to the second power source line; and wherein the switching circuit supplies one of the first potential, the second potential, and the third potential to the gate terminal of the first P-channel transistor.

Further, in the present invention, a potential of the first power source line may be lower than a potential of the second power source line.

In the present invention, the light-emitting element may be an electroluminescent element.

One feature of the present invention is a display device having a semiconductor device. The display device includes a display portion including a plurality of pixels and a driver circuit; each pixel including a first transistor of which a gate terminal is connected to a data line and a first terminal is connected to a first power source line; a second transistor of which a gate terminal is connected to a first scan line, and a first terminal is connected to a second terminal of the first transistor; a memory circuit; a switching circuit; and a third transistor of which a gate terminal is connected to the switching circuit and a second terminal is connected to a light-emitting element, wherein the memory circuit is connected to a second terminal of the second transistor and a second scan line; wherein the switching circuit is connected to the second terminal of the second transistor, the memory circuit and a third scan line; and wherein the switching circuit conducts switching between the third transistor, and the memory circuit and the second power source line, and applies an input potential to the gate terminal of the third transistor In the present invention, the first and second transistors may be N-channel transistors and the third transistor may be a P-channel transistor.

One feature of the present invention is a display device having a semiconductor device. The display device includes a display portion including a plurality of pixels and a driver circuit; each pixel including a first N-channel transistor of which a gate terminal is connected to a data line and a first terminal is connected to a first power source line; a second N-channel transistor of which a gate terminal is connected to a first scan line and a first terminal is connected to a second terminal of the first N-channel transistor; a memory circuit; a switching circuit; and a first P-channel transistor of which a first terminal is connected to a second power source line and a second terminal is connected to a light-emitting element, the memory circuit including a NOR circuit of which a first input terminal is connected to a second terminal of the second N-channel transistor and a second input terminal is connected to a second scan line; a third N-channel transistor of which a gate terminal is connected to an output terminal of the NOR circuit and a first terminal is connected to the first power source line; a second P-channel transistor of which a gate terminal is connected to the first scan line and a first terminal is connected to the second power source line; and a third P-channel transistor of which a gate terminal is connected to the output terminal of the NOR circuit, a first terminal is connected to a second terminal of the second P-channel transistor, and a second terminal is connected to a second terminal of the third N-channel transistor; the switching circuit including a fourth N-channel transistor of which a gate terminal is connected to a third scan line, a first terminal is connected to the second terminal of the second N-channel transistor, the second terminal of the third N-channel transistor, and the second terminal of the third P-channel transistor, and a second terminal is connected to a gate terminal of the first P-channel transistor; and a fourth P-channel transistor of which a gate terminal is connected to the third scan line, a first terminal is connected to the second power source line, and a second terminal is connected to the second terminal of the fourth N-channel transistor and the gate terminal of the first P-channel transistor; wherein a first potential for turning off the first P-channel transistor or a second potential for turning off the first P-channel transistor is input to the memory circuit, wherein a third potential for turning off the first P-channel transistor is input to the second power source line; and wherein the switching circuit supplies one of the first potential, the second potential, and the third potential to the gate terminal of the first P-channel transistor.

Further, in the present invention, a potential of the first power source line may be lower than a potential of the second power source line.

In the present invention, the light-emitting element may be an electroluminescent element.

One feature of the present invention is an electronic device including a display panel having a semiconductor device. The display panel includes a display portion including a plurality of pixels and a driver circuit; each pixel including a first transistor of which a gate terminal is connected to a data line and a first terminal is connected to a first power source line; a second transistor of which a gate terminal is connected to a first scan line and a first terminal is connected to a second terminal of the first transistor; a memory circuit; a switching circuit; and a third transistor of which a gate terminal is connected to the switching circuit and a second terminal is connected to a light-emitting element, wherein the memory circuit is connected to a second terminal of the second transistor and a second scan line; wherein the switching circuit is connected to the second terminal of the second transistor, the memory circuit and a third scan line; and wherein the switching circuit conducts switching between the third transistor, and the memory circuit and the second power source line and applies an input potential to the gate terminal of the third transistor.

In the present invention, the first and second transistors may be N-channel transistors and the third transistor may be a P-channel transistor.

One feature of the present invention is an electronic device including a display panel having a semiconductor device. The display portion includes a display portion including a plurality of pixels and a driver circuit; each pixel including a first N-channel transistor of which a gate terminal is connected to a data line and a first terminal is connected to a first power source line; a second N-channel transistor of which a gate terminal is connected to a first scan line and a first terminal is connected to a second terminal of the first N-channel transistor; a memory circuit; a switching circuit; and a first P-channel transistor of which a first terminal is connected to a second power source line and a second terminal is connected to a light-emitting element, the memory circuit including a NOR circuit of which a first input terminal is connected to a second terminal of the second N-channel transistor and a second input terminal is connected to a second scan line; a third N-channel transistor of which a gate terminal is connected to an output terminal of the NOR circuit and a first terminal is connected to the first power source line; a second P-channel transistor of which a gate terminal is connected to the first scan line and a first terminal is connected to the second power source line; and a third P-channel transistor of which a gate terminal is connected to the output terminal of the NOR circuit, a first terminal is connected to a second terminal of the second P-channel transistor, and a second terminal is connected to a second terminal of the third N-channel transistor; the switching circuit including a fourth N-channel transistor of which a gate terminal is connected to a third scan line, a first terminal is connected to the second terminal of the second N-channel transistor, the second terminal of the third N-channel transistor and the second terminal of the third P-channel transistor, and a second terminal is connected to a gate terminal of the first P-channel transistor; and a fourth P-channel transistor of which a gate terminal is connected to the third scan line, a first terminal is connected to the second power source line, and a second terminal is connected to the second terminal of the fourth N-channel transistor and the gate terminal of the first P-channel transistor; wherein a first potential for turning on the first P-channel transistor or a second potential for turning off the first P-channel transistor is input to the memory circuit; wherein a third potential for turning off the first P-channel transistor is input to the second power source line; and wherein the switching circuit supplies one of the first potential, the second potential, and the third potential to the gate terminal of the first P-channel transistor.

Further, in the present invention, a potential of the first power source line may be lower than a potential of the second power source line.

In the present invention, the light-emitting element may be an electroluminescent element.

In the present invention, as the second scan line, a first scan line which is at the previous row, may be used.

In the present invention, a capacitor element may be additionally provided, one electrode of which is connected to the gate terminal of the third P-channel transistor and the other electrode of which is connected to the first power source line.

In addition, the present invention provides electronic devices such as television receivers, cameras (e.g., video cameras or digital cameras), goggle type displays, navigation system, audio reproducing devices, computers, game machines, mobile computers, portable phones, portable game machines, electronic books, or image reproducing devices.

In a semiconductor device having a light-emitting element in accordance with the present invention, a constant potential is continuously supplied to a gate terminal of a driving transistor regardless of whether the light-emitting element is in the emission state or non-emission state. Therefore, more stable operation can be performed compared with the conventional pixel configuration where a potential is held in a storage capacitor.

Further, in the semiconductor device of the present invention, on or off potentials applied to a gate terminal of a driving transistor can be set separately from a potential of a data line. Accordingly, the potential amplitude of the data line can be set small, and thus a semiconductor device with significantly suppressed power consumption can be provided.

Further, in the semiconductor device of the present invention, even when signal supply is stopped to a memory circuit in each pixel of the pixel portion from a scan line driver circuit and a data line driver circuit that are disposed at the periphery of the pixel portion, signal data immediately before the signal supply is stopped can be held; therefore, a light-emitting element can keep the emission state or non-emission state.

Further, even when erasing is conducted, a semiconductor device of the present invention can display an image without supplying data again to pixels, in the case of a still image with one bit for each R, G and B (eight colors).

Further, a semiconductor device of the present invention can easily determine brightness based on a length of an emission period, in the case of a still image with one bit for each R, G and B (eight colors).

In addition, by applying the present invention to a display device, a potential for making a light-emitting element be in the emission state or non-emission state is continuously and stably supplied to a gate terminal of a driving transistor. Therefore, more stable display operation can be performed compared with the conventional pixel configuration where a potential is held in a storage capacitor.

Further, in the display device of the present invention, on or off potentials applied to a gate terminal of a driving transistor can be set separately from a potential of a data line. Accordingly, the potential amplitude of the data line can be set small, and thus a display device with significantly suppressed power consumption can be provided.

Further, in the display device of the present invention, even when a signal supply is stopped to a memory circuit in each pixel of the pixel portion from a scan line driver circuit and a data line driver circuit that are disposed at the periphery of the pixel portion, signal data immediately before the signal supply is stopped can be held; therefore, a light-emitting element can keep the emission state or non-emission state and an image can be displayed.

Further, in an electronic device using the semiconductor device of the present invention, a constant potential is continuously supplied to a gate terminal of a driving transistor regardless of whether a light-emitting element is in the emission state or non-emission state. Therefore, more stable display operation can be performed compared with the conventional pixel configuration where a potential is held in a storage capacitor. Thus, products which can display images by stable display operation can be manufactured and less defective products can be provided to customers.

Further, in the electronic device of the present invention, on or off potentials applied to a gate terminal of a driving transistor can be set separately from a potential of a data line. Accordingly, the potential amplitude of the data line can be set small, and thus an electronic device with significantly suppressed power consumption can be provided.

Further, in the electronic device having the display device of the present invention, even when a signal supply is stopped to a memory circuit in each pixel of a pixel portion from a scan line driver circuit and a data line driver circuit that are disposed at the periphery of the pixel portion, signal data immediately before the signal supply is stopped can be held; therefore, a light-emitting element can keep the emission state or non-emission state and an image can be displayed.

In the case of a still image with one bit for each R, G and B (eight colors), even if signal supply is stopped to a memory circuit in each pixel of a pixel portion from a scan line driver circuit and a data line driver circuit that are disposed at the periphery of the pixel portion, an electronic device of the present invention can return to an emission state from a non-emission state, using signal data immediately before stopping the signal supply,

DETAILED DESCRIPTION OF THE INVENTION

Embodiment Modes

Figure 1:
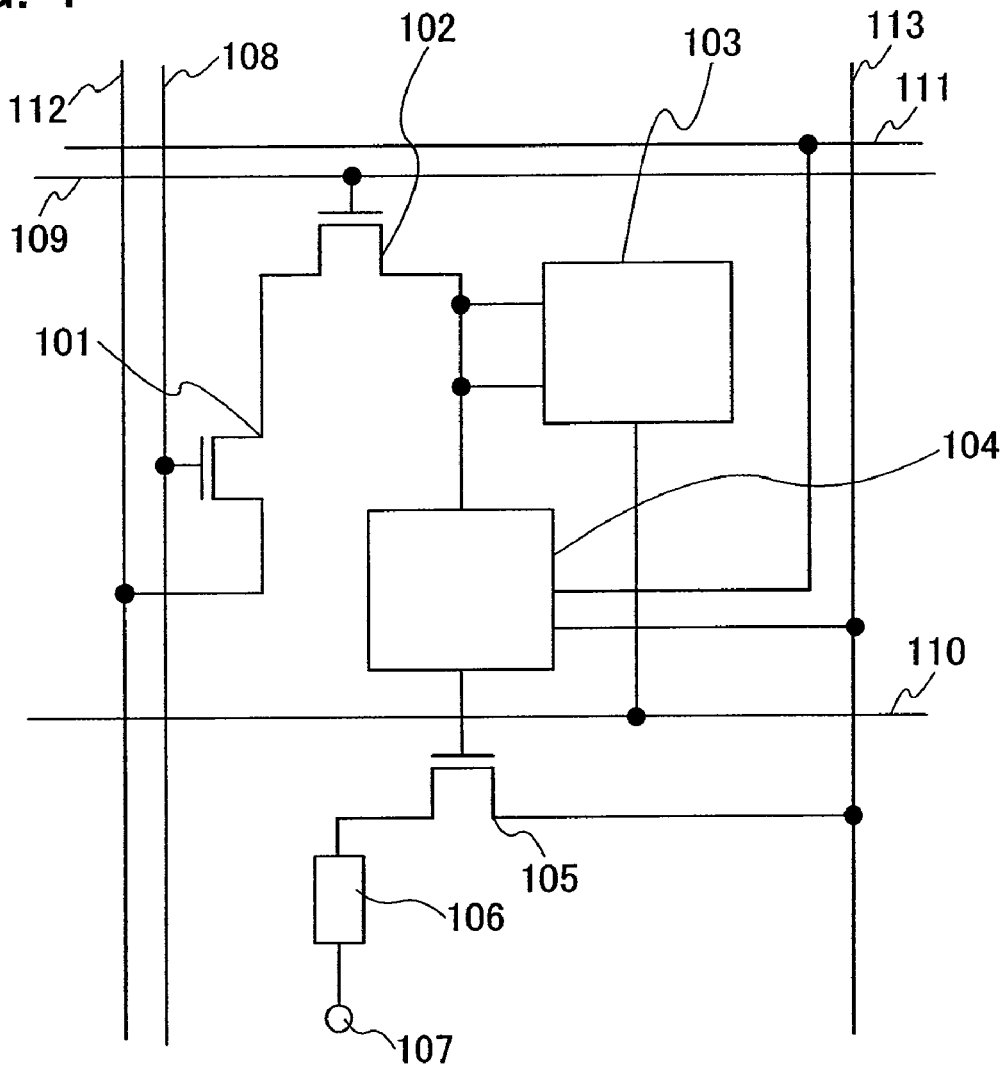
FIG. 1 shows a circuit diagram in accordance with Embodiment Mode of the present invention.

Embodiment Mode and Embodiments of the present invention will be described with reference to the drawings. The present invention can be carried out in many different modes. It is easily understood by those skilled in the art that modes and details disclosed herein can be modified in various ways without departing from the spirit and the scope of the present invention. It should be noted that the present invention should not be interpreted as being limited to the description of the embodiment mode and embodiments given below. Note that like portions or portions having a like function are denoted by the same reference numerals through drawings, and therefore, description thereon is omitted.

First, a pixel configuration and an operation principle of a semiconductor device of the present invention will be described.

FIG. 1 shows a pixel configuration of the present invention. Although only one pixel is shown here, the pixel portion of the semiconductor device actually includes multiple pixels that are arranged in matrix of rows and columns.

A pixel includes a data transistor 101 (also referred to as a first transistor), a switch transistor 102 (also referred to as a second transistor), a memory circuit 103, a driving transistor 105 (also referred to as a third transistor), a data line 108, a first power source line 112, a second power source line 113, a first scan line 109, a second scan line 110, a third scan line 111, a light-emitting element 106, a counter electrode 107, and a switching circuit 104.

A first terminal (one of source and drain terminals) of the data transistor 101 is connected to the first power source line 112, a gate terminal thereof is connected to the data line 108, and a second terminal (the other of the source and drain terminals) thereof is connected to a first terminal (one of source and drain terminals) of the switch transistor 102. In addition, a gate terminal of the switch transistor 102 is connected to the first scan line 109, and a second terminal (the other of the source and drain terminals) thereof is connected to input and output terminals of the memory circuit 103 and a first input terminal of the switching circuit 104. In addition, the memory circuit 103 is connected to the first input terminal of the switching circuit 104, the second terminal of the switch transistor 102 and the second scan line 110. A second input terminal of the switching circuit 104 is connected to the second power source line 113, a third input terminal thereof is connected to the third scan line 111, an output terminal thereof is connected to a gate terminal of the driving transistor 105. A first terminal (one of source and drain terminals) of the driving transistor 105 is connected to the second power source line 113, and a gate terminal thereof is connected to the input and output terminals of the memory circuit 103 and the second terminal of the switch transistor 102, and a second terminal (the other of the source and drain terminals) thereof is connected to one electrode of the light-emitting element 106. In addition, the other electrode of the light-emitting element 106 is connected to the counter electrode 107.

Note that the first power source line 112 is set at a potential Vc which is lower than the second power source line 113. That is, $Vc<Vdd$ is satisfied, where Vdd is a standard potential set to the second power source line 113 during the emission period of the pixel. That is, $|Vth|<|Vgs|$ is satisfied, where $|Vgs|$ is the absolute value of a voltage between the gate and the source of the driving transistor 105, and $|Vth|$ is the absolute value of the threshold voltage of the driving transistor 105. For example, Vc may be equal to GND (ground potential).

Note that the first terminal of the data transistor 101 may be connected anywhere as long as it is connected to a wiring set at the potential Vc which is lower than the second power source line 113 during the period when the data transistor 101 is on. For example, such a configuration may be provided that a second scan line 110 which is provided in the adjacent pixels is set at the potential of Vc during the period when the data transistor 101 is on, so that the potential of Vc may be supplied to the pixel from the second scan line 110.

Note that the counter electrode (cathode) 107 of the light-emitting element 106 is set at a potential Vss lower than the second power source line 113. That is, $Vss<Vdd$ is satisfied, where Vdd is a standard potential set to the second power source line 113 during the emission period of the pixel. For example, Vss may be equal to GND (ground potential). In addition, potentials of the first power source line 112 and the counter electrode 107 may be equal to GND.

Note that, in this specification, a signal input to the driving transistor for turning the light-emitting element into the emission state is called a first signal, while a signal input to the driving transistor for turning the light-emitting element into the non-emission state is called a second signal.

Figure 2:
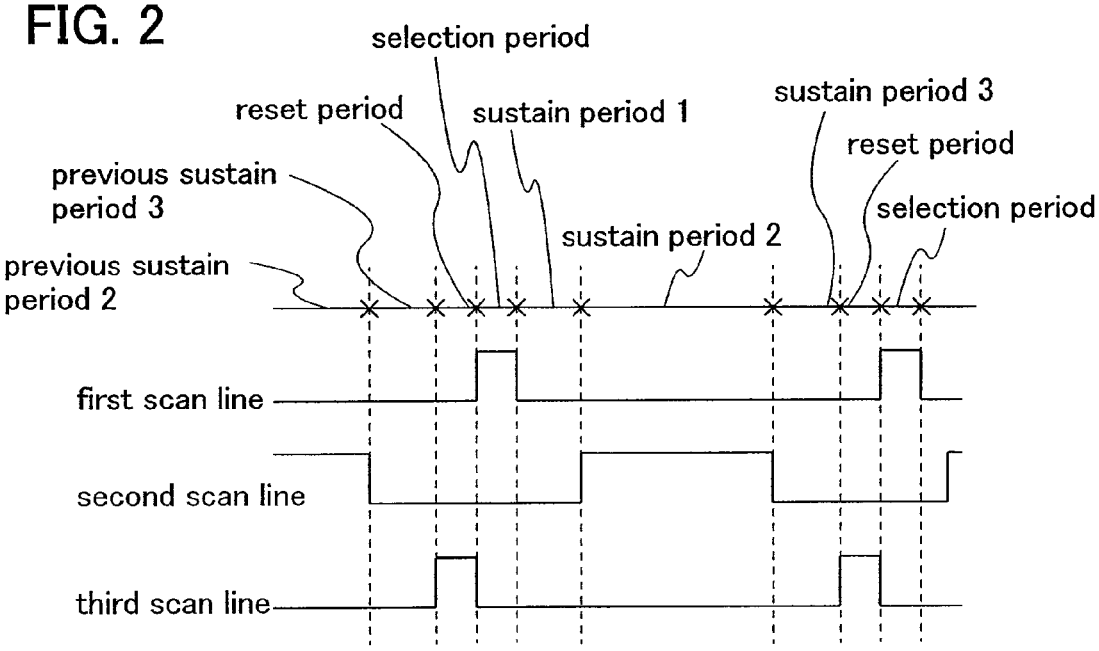
FIG. 2 shows one mode in accordance with Embodiment Mode of the present invention.

Next, with reference to FIG. 2, an operation method of the pixel configuration shown in FIG. 1 is described.

Note that in the description along with FIG. 2, an N-channel transistor is used for the data transistor 101, an N-channel transistor is used for the switch transistor 102, and a P-channel transistor is used for the driving transistor 105. However, there are no particular limitations on the polarity of each transistor, as long as such transistors which can perform the same operation as each transistor of the present invention by changing a potential of a wiring connected to a terminal of each transistor as appropriate. In addition, when the direction of a current flowing in the light-emitting element is changed, the potentials of the second power source line 113 and the counter electrode 107 may be appropriately set similarly to the case of changing the polarity of each transistor as described above.

First, FIG. 2 shows a timing chart of potentials at the first scan line 109, the second scan line 110, and the third scan line 111 in the pixel configuration of the present invention. In the pixel configuration of the present invention, an emission state or non-emission state of each pixel is selected by providing a reset period, a selection period, a sustain period 1, a sustain period 2, and a sustain period 3.

In the pixel configuration of the present invention, a signal for controlling on or off of the driving transistor 105, which has conventionally been input from a data line 108, is not input. Therefore, a reset signal (non-emission signal) should be input into the memory circuit 103 in the pixel in advance. Such a period when a reset signal is input into the memory circuit 103 in the pixel in advance is called a reset period in this specification.

Although FIG. 2 shows an example where the operations in the reset period and the selection period are sequentially performed, a time margin is preferably provided between the reset period and the selection period. By providing the time margin between the reset period and the selection period, a potential from a data line can be input into the pixel without malfunctions.

In the reset period, data of non emission, that is, a potential which turns off the driving transistor 105 is input to the memory circuit 103, irrespective of which types of data is stored there before the reset period.

In the reset period, the potential which turns off the driving transistor 105 is applied to the gate terminal of the driving transistor 105, by the switching circuit 104 which is controlled by the potential of the third scan line 111.

In the selection period, the switch transistor 102 is turned on by the first scan line 109, and on or off of the data transistor 101 is determined by the potential of the data line 108. When the data line 108 has High potential, the data transistor 101 is turned on and data of emission, that is, a potential which turns on the driving transistor 105 is input to the memory circuit 103. On the other hand, when the data line 108 has Low potential, the data transistor 101 is turned off, and data of non emission, that is, a potential which turns off the driving transistor 105 is input to the memory circuit 103.

In the selection period, the data stored in the memory circuit 103, that is, the potential which turns on or off the driving transistor 105 is applied to the gate terminal of the driving transistor 105, by the switching circuit 104 controlled by the potential of the third scan line 111.

In the sustain period 1 and the sustain period 3, the potential which turns off the driving transistor 105 is applied to the gate terminal of the driving transistor 105, by the switching circuit 104 which is controlled by the potential of the third scan line 111, without depending on the data stored in the memory circuit 103, and thus, the light-emitting element 106 turns into non-emission state.

In the sustain period 2, the potential which turns on or off the driving transistor 105 is applied to the gate terminal of the driving transistor 105 in accordance with the data stored in the memory circuit 103 by the switching circuit 104, and thus, an emission state or non-emission state of the light-emitting element 106 is determined.

Note that the potential of the gate terminal of the driving transistor 105 in the holding period is held in the memory circuit 103. Accordingly, unlike a pixel configuration using a storage capacitor, there are almost no problems concerning malfunctions that would be caused when a potential applied to the gate terminal of the driving transistor 105 fluctuates due to noise, a leakage from the switch transistor 102, or the like.

Note that in the aforementioned holding period in which a light-emitting element keeps the emission state or non-emission state, even when a signal supply is stopped to the memory circuit 103 in each pixel of the pixel portion from a scan line driver circuit and a data line driver circuit that are disposed at the periphery of the pixel portion, signal data immediately before stopping of the signal supply can be held in the memory circuit 103; therefore, the light-emitting element can keep the emission state. Therefore, neither the scan line driver circuit nor the data line driver circuit is required to be operated for displaying a still image or the like by using the semiconductor device of the present invention, and thus significant reduction in power consumption can be expected.

With data stored in the memory circuit by the switching circuit 104, the pixel can be in non-emission state. Thus, in the case of a still image with one bit for each R, G and B (eight colors), even when the pixel is in non-emission state, display can be conducted again without supplying a signal to the pixel portion from the data line driver circuit. The data line driver circuit is not needed to be driven, and thus, power consumption can be reduced drastically.

Embodiment 1

Embodiment 1 will describe a specific pixel configuration and an operation principle of a semiconductor device of the present invention.

Figure 3:
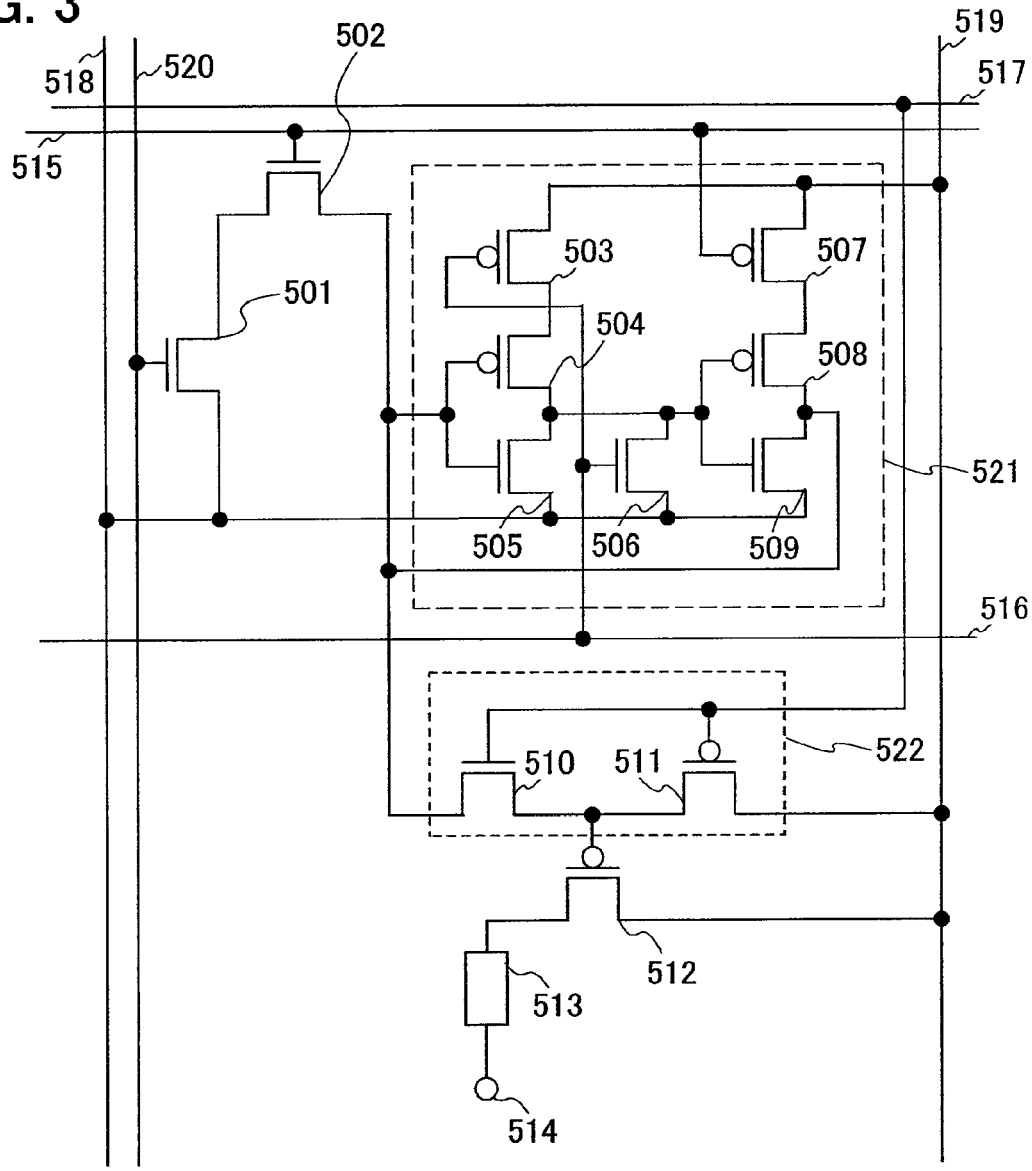
FIG. 3 shows a circuit diagram in accordance with Embodiment 1 of the present invention.

First, with reference to FIG. 3, a pixel configuration of a semiconductor device of the present invention is described. Although only one pixel is shown here, the pixel portion of the semiconductor device actually includes multiple pixels that are arranged in matrix of rows and columns.

The pixel includes a data transistor 501, a switch transistor 502, a NOR circuit including transistors 503 to 506, a transistor 507, a transistor 508, a transistor 509, a transistor 510, a transistor 511, a driving transistor 512, a data line 520, a first power source line 518, a second power source line 519, a first scan line 515, a second scan line 516, a third scan line 517, a light-emitting element 513, and a counter electrode 514. In this embodiment, the NOR circuit, the transistor 507, the transistor 508 and the transistor 509 are collectively referred to as a memory circuit 521. In addition, the transistor 510 and the transistor 511 are collectively referred to as a switching circuit 522. Note that the data transistor 501 is an N-channel transistor, the switch transistor 502 is an N-channel transistor, the transistors 503 and 504 are P-channel transistors, the transistors 505 and 506 are N-channel transistors, the transistor 510 is an N-channel transistor, the transistor 511 is a P-channel transistor and the driving transistor 512 is a P-channel transistor. Note that there are no particular limitations on the polarities of these transistors, as long as transistors which can perform the same operation as the respective transistors of the present invention are used, by changing a potential of a wiring connected to a terminal of each transistor.

A first terminal (source terminal or drain terminal) of the data transistor 501 is connected to the first power source line 518, a gate terminal thereof is connected to the data line 520, and a second terminal (source terminal or drain terminal) thereof is connected to a first terminal (source terminal or drain terminal) of the switch transistor 502. The NOR circuit includes the transistor 503, the transistor 504, the transistor 505, and the transistor 506. Gate terminals of the transistors 504 and 505 which are connected to each other are regarded as a first input terminal, and gate terminals of the transistors 503 and 506 which are connected to each other are regarded as a second input terminal. Second terminals (either source terminal or drain terminal of each) of the transistor 504 and the transistor 505 which are connected are regarded as an output terminal. In addition, the gate terminal of the switch transistor 502 is connected to the first scan line 515, and a second terminal (the other of the source and drain terminals) of the switch transistor 502 is connected to the first input terminal of the NOR circuit, in other words, the gate terminals of the transistor 504 and the transistor 505, a second terminal (source terminal or drain terminal) of the transistor 508, a second terminal (source terminal or drain terminal) of the transistor 509, and a first terminal (source terminal or drain terminal) of the transistor 510. A first terminal (source terminal or drain terminal) of the transistor 503 is connected to the second power source line 519. In addition, a first terminal (source terminal or drain terminal) of the transistor 505 is connected to the first power source line 518. In addition, a first terminal (source terminal or drain terminal) of the transistor 506 is connected to the first power source line 518. The other input terminal of the NOR circuit is connected to the second scan line 516, and the output terminal is connected to a gate terminal of the transistor 508 and a gate terminal of the transistor 509. A first terminal (source terminal or drain terminal) of the transistor 507 is connected to the second power source line 519, a gate terminal thereof is connected to the first scan line 515, and a second terminal (source terminal or drain terminal) thereof is connected to a first terminal (source terminal or drain terminal) of the transistor 508. In addition, a first terminal (source terminal or drain terminal) of the transistor 509 is connected to the first power source line 518. In addition, a gate terminal of the transistor 510 is connected to the third scan line 517, a second terminal (source terminal or drain terminal) thereof is connected to a gate terminal of the driving transistor 512 and a second terminal (source terminal or drain terminal) of the transistor 511. A first terminal (source terminal or drain terminal) of the transistor 511 is connected to the second power source line 519, and a gate terminal thereof is connected to the third scan line 517. A first terminal (source terminal or drain terminal) of the driving transistor 512 is connected to the second power source line 519, and a second terminal (a source terminal or a drain terminal) of the driving transistor 512 is connected to one electrode of the light-emitting element 513. The other electrode of the light-emitting element 513 is connected to the counter electrode 514.

Note that the first power source line 518 is set at a potential Vc which is lower than the second power source line 519. Note that Vc<Vdd is satisfied, where Vdd is a potential set to the second power source line 519 during the emission period of the pixel. That is, |Vth|<|Vgs| is satisfied, where |Vgs| is the absolute value of the voltage between the gate and the source of the driving transistor 512, and |Vth| is the absolute value of the threshold voltage of the driving transistor 512. For example, Vc may be equal to GND (ground potential).

Note that the counter electrode (cathode) 514 of the light-emitting element 513 is set at a potential Vss which is lower than the second power source line 519. Note also that Vss<Vdd is satisfied, where Vdd is a potential set to the second power source line 519 during the emission period of the pixel. For example, Vss may be equal to GND (ground potential). In addition, the first power source line 518 and the counter electrode may be equal to GND.

A timing chart of potentials of the first scan line 515, the second scan line 516 and the third scan line 517 in the pixel configuration of the present invention is the same as that in Embodiment Mode 1, and thus, description thereof is omitted.

In the pixel configuration of the present invention, a signal for controlling on or off of the driving transistor 512, which have conventionally been input from the data line 520, is not input. Therefore, a reset signal (non-emission signal) should be input into the memory circuit 521 in the pixel in advance. Such a period when the reset signal is input into the memory circuit 521 in the pixel in advance is called a reset period in this specification.

Although FIG. 2 shows an example where the operations in the reset period and the selection period are sequentially performed, a time margin is preferably provided between the reset period and the selection period. By providing the time margin between the reset period and the selection period, a potential from a data line can be input into the pixel without malfunctions.

In the reset period, data of non emission, that is, a potential which turns off the driving transistor 512 is input to the memory circuit 521, irrespective of which types of data is stored before the reset period.

In the reset period, the potential which turns off the driving transistor 512 is applied to the gate terminal of the driving transistor 512, by the switching circuit 522 which is controlled by the potential of the second scan line 516.

In the selection period, the switch transistor 502 is turned on by the first scan line 515, and whether the data transistor 501 is turned on or off is determined by the potential of the data line 502 to be input to the gate terminal. When the data line 520 has High potential, the data transistor 501 is turned on and data of emission, that is, a potential which turns off the driving transistor 512 is input to the memory circuit 521. On the other hand, when the data line 520 has Low potential, the data transistor 501 is turned off, and data of non emission, that is, a potential which turns off the driving transistor 512 is input to the memory circuit 521.

In the selection period, the potential which turns off the driving transistor 512 is input to the gate terminal of the driving transistor 512, by turning on the transistor 511 of the switching circuit 522 controlled by the potential of the third scan line 517.

In the sustain period 1 and the sustain period 3, the potential which turns off the driving transistor 512 is applied to the gate terminal of the driving transistor 512, without depending on the data stored in the memory circuit 521, by turning on the transistor 511 of the switching circuit 522 controlled by the potential of the third scan line 517, and thus, no current flows into the light-emitting element 513 and the light-emitting element 513 is in non-emission state.

In the sustain period 2, the potential which turns on or off the driving transistor 512 is applied to the gate terminal of the driving transistor 512 in accordance with data stored in the memory circuit 521, by turning on the transistor 510 of the switching circuit 522 controlled by the potential of the third scan line 517, and thus, the light-emitting element 513 turns into an emission state or non-emission state.

Note that the potential of the gate terminal of the driving transistor 512 in the holding period is held in the memory circuit 521. Accordingly, compared with a pixel configuration using a storage capacitor, there are fewer problems concerning malfunctions that would be caused when a potential applied to the gate terminal of the driving transistor 512 fluctuates due to noise, leakage from the switch transistor 502, or the like.

As for keeping the emission state and non-emission state, in the holding period, even when a signal supply is stopped to the memory circuit 521 in each pixel of the pixel portion from a scan line driver circuit and a data line driver circuit that are disposed at the periphery of the pixel portion, signal data immediately before stopping the signal supply can be held in the memory circuit 521; therefore, the light-emitting element 513 can hold the emission state. Therefore, neither the scan line driver circuit nor the data line driver circuit is required to be operated for displaying a still image or the like by using the semiconductor device of the present invention, and thus significant reduction in power consumption can be expected.

With data stored in the memory circuit 521 by the switching circuit 522, the pixel can be in non-emission state. Thus, in the case of a still image with one bit for each R, G and B (eight colors), even when the pixel is in non-emission state, display can be conducted again without supplying a signal to the pixel portion from the data line driver circuit. The data line driver circuit is not needed to be driven, and thus, power consumption can be reduced drastically.

Note that this embodiment mode can be freely combined with the above embodiment mode.

Embodiment 2

Embodiment 2 will describe a gray scale expression method where gray scales are expressed by a time gray scale method in the semiconductor device of the present invention described in Embodiment 1.

A semiconductor device of the present invention is operated by an SES (Simultaneous Erasing Scan) drive. In order to achieve multi-gray scale display by the time gray scale method, an erasing TFT has been required to be used conventionally. In the present invention, such an erasing transistor is not required to be provided additionally since a reset period is provided before each selection period.

Figure 4:
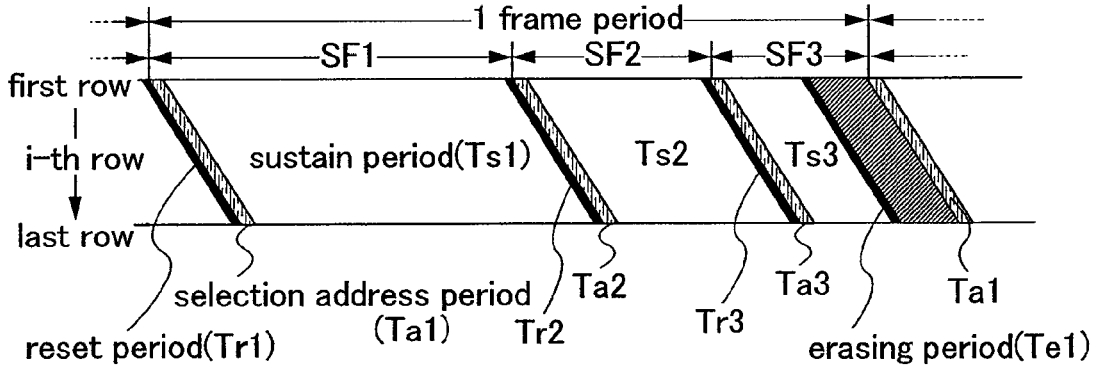
FIG. 4 shows a timing chart in accordance with Embodiment 2 of the present invention.

FIG. 4 shows an example in which gray scales are expressed by a time gray scale method. FIG. 4 is a timing chart for 3-bit gray scales, where reset periods Tr1 to Tr3, selection address (writing) periods Ta1 to Ta3, and sustain (emission) periods Ts1 to Ts3 are provided for the respective bits, and an erasing period Tel.

In the erasing period of this embodiment, operation in the reset period in Embodiment 1 is performed. In other words, the operation is an operation for rewriting a signal for holding the emission state stored in the memory circuit into a signal for holding the non-emission state.

The reset periods and the selection address (writing) periods each correspond to the period required for inputting video signals to pixels for one image screen; therefore the reset period in each bit has an equal length and the selection address (writing) period in each bit has an equal length. To the contrary, each of the sustain (emission) periods has a squared length of the previous period (e.g., $1:2:4:\ldots:2^{(n-1)}$), and gray scales are expressed by total emission periods. In the example of FIG. 4, 3-bit gray scales are to be expressed; therefore, each length of the sustain (emission) periods satisfy such ratio as 1:2:4.

The erasing period is originally provided in order to prevent the selection address (writing) period in the present sub-frame from overlapping the address period in the next sub-frame and prevent different gate signal lines from being selected concurrently, in the case where the sustain (emission) periods are short.

This embodiment can be freely combined with any of the aforementioned embodiment mode and other embodiments.

Embodiment 3

A top view and a cross-sectional view of a light-emitting device of the present invention is described with reference to drawings. More specifically, the top view and the cross-sectional view of a light-emitting device including a data transistor, a driving transistor, and a light-emitting element are described with reference to FIGS. 5A, 5B and 6.

Figure 5B:
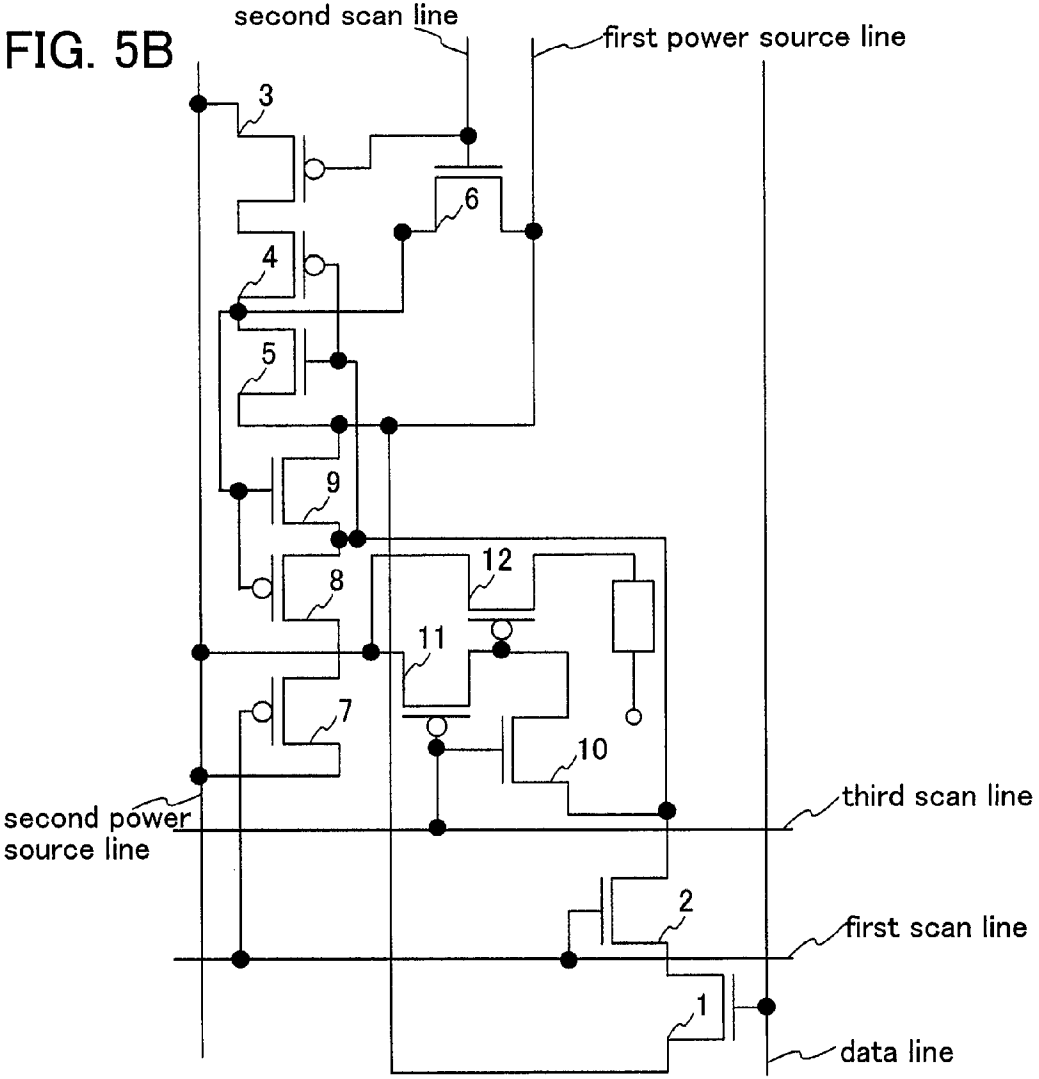
FIG. 5A and FIG. 5B are a circuit diagram and a top view in accordance with Embodiment 3 of the present invention.
Figure 5A:
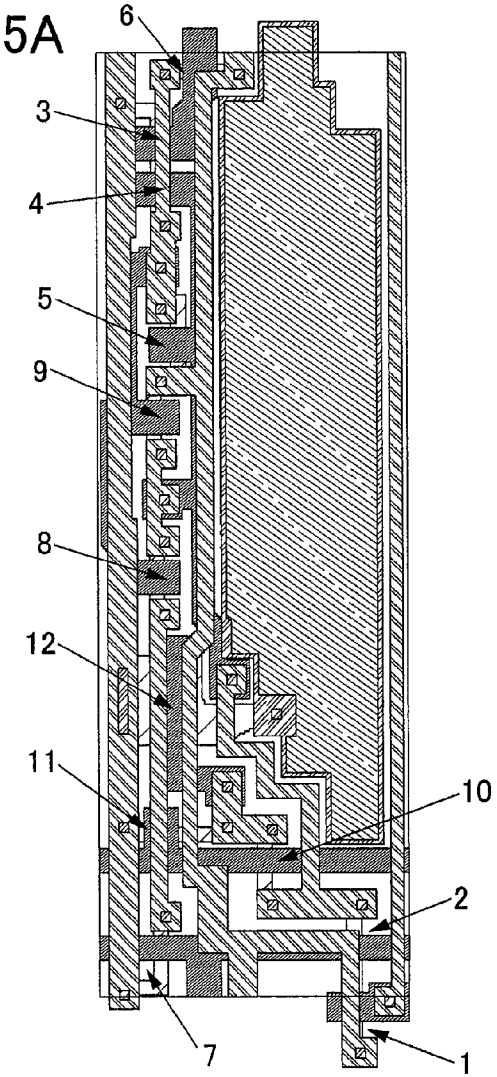

FIG. 5A is a top view of a semiconductor device of the present invention and FIG. 5B is a circuit diagram of the top view in FIG. 5A. As shown in FIG. 5A and FIG. 5B, a capacitor element may be connected to a gate terminal of a driving transistor as necessary. Note that in FIGS. 5A and 5B, each reference numeral of 1 to 12 indicates the corresponding transistors. In this example, the second scan line is connected to the first scan line at the previous row.

Figure 6:
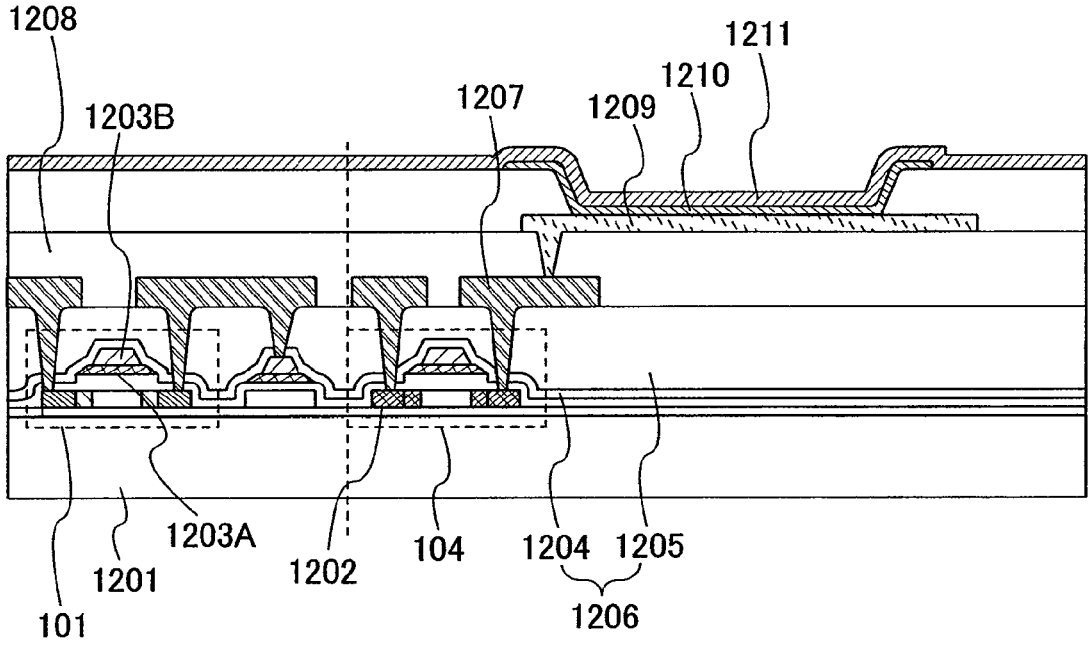
FIG. 6 is a cross-sectional view in accordance with Embodiment 3 of the present invention.

FIG. 6 shows a cross-sectional view corresponding to the top view of FIG. 5A in the area between the GND and the data transistor and between the driving transistor and the light-emitting element. Next, a stacked-layer structure is described.

In FIG. 6, as a substrate 1201 having an insulating surface, a glass substrate, a quartz substrate, a stainless steel substrate or the like can be used. Alternatively, a substrate formed from a flexible synthetic resin such as plastic typified by polyethylene terephthalate (PET) or polyethylene naphthalate (PEN), or acrylic may be used, as long as it can resist processing temperature in the manufacturing process.

First, a base film is formed over the substrate 1201. The base film may be an insulating film formed of silicon oxide, silicon nitride, silicon nitride oxide or the like. Then, an amorphous semiconductor film is formed over the base film. The amorphous semiconductor film has a thickness of 25 to 100 nm. In addition, the amorphous semiconductor film can be not only silicon but also silicon germanium. Subsequently, the amorphous semiconductor film is crystallized as necessary, thereby forming a crystalline semiconductor film 1202. The crystallization may be performed using a heating furnace, laser irradiation, irradiation with light emitted from a lamp, or a combination of them. For example, after adding a metal element into the amorphous semiconductor film, a thermal treatment using a heating furnace is applied thereto to form a crystalline semiconductor film. In this manner, it is preferable to add a metal element since crystallization can be performed at a low temperature.

Note that a thin film transistor (TFT) formed from a crystalline semiconductor film has higher electron field-effect mobility than a TFT formed from an amorphous semiconductor film, and thus has large on current; therefore, it is more suitable for a semiconductor device.

Then, the crystalline semiconductor film 1202 is patterned into a predetermined shape. Then, an insulating film functioning as a gate insulating film is formed. The insulating film is formed with a thickness of 10 to 150 nm so as to cover the semiconductor film. For example, the insulating film can be formed from a silicon oxynitride film, a silicon oxide film or the like, and may be formed either to have a single-layer structure or a stacked-layer structure.

Then, a conductive film functioning as a gate electrode is formed over the gate insulating film. Although the gate electrode may be formed to have either a single-layer structure or a stacked-layer structure, it is formed by stacking conductive films herein. Conductive films 1203A and 1203B are each formed using an element selected from tantalum (Ta), aluminum (Al), titanium (Ti), molybdenum (Mo), tungsten (W), or copper (Cu), or an alloy material or a compound material containing such elements as a main component. In this embodiment, the conductive film 1203A is formed of a tantalum nitride film with a thickness of 10 to 50 nm, and the conductive film 1203B is formed of a tungsten film with a thickness of 200 to 400 nm.

Next, an impurity element is added, using the gate electrode as a mask, thereby forming an impurity region. At this time, a low concentration impurity region may be formed in addition to a high concentration impurity region. The low concentration impurity region is called LDD (Lightly Doped Drain) region.

Next, insulating films 1204 and 1205 are formed to function as an interlayer insulating film 1206. The insulating film 1204 is preferably an insulating film containing nitrogen, and here it is formed using a silicon nitride film with a thickness of 100 nm by plasma CVD. The insulating film 1205 is preferably formed using an organic material or an inorganic material. As the organic material, there are polyimide, acrylic, polyamide, polyimide amide, benzocyclobutene, and siloxane. Siloxane has a skeleton structure formed with the bond of silicon (Si) and oxygen (O), a substituent of which includes an organic group containing at least hydrogen (e.g., an alkyl group or aromatic hydrocarbon). In addition, a fluoro group may be used as the substituent, or both a fluoro group and an organic group containing at least hydrogen may be used as the substituent. As the inorganic material, there is an insulating film containing oxygen or nitrogen such as silicon oxide ($SiO_x$), silicon nitride ($SiN_x$), silicon oxynitride ($SiO_xN_y$) (x>y) or a silicon nitride oxide ($SiN_xO_y$) (x>y) (where x and y are natural numbers respectively). Note that although a film formed from an organic material has an excellent planarity, moisture or oxygen is absorbed into the organic material. In order to prevent this, an insulating film containing an inorganic material is preferably formed over the insulating film formed from the organic material.

Next, after forming contact holes in the interlayer insulating film 1206, a conductive film 1207 functioning as source and drain wirings of transistors is formed. The conductive film 1207 is formed using an element selected from aluminum (Al), titanium (Ti), molybdenum (Mo), tungsten (W) or silicon (Si), or an alloy film containing such elements. In this embodiment, a titanium film, a titanium nitride film, a titanium-aluminum alloy film, and a titanium film are stacked.

Then, an insulating film 1208 is formed to cover the conductive film 1207. The insulating film 1208 can be formed from using any of materials shown as an example of the interlayer insulating film 1206. Then, a pixel electrode (also referred to as a first electrode) 1209 is formed in an opening portion provided in the insulating film 1208. The opening portion is preferably formed to have a roundish end surface with multiple curvature radii in order to increase the step coverage of the pixel electrode 1209.

The pixel electrode 1209 is preferably formed using a conductive material with a high work function (4.0 eV or higher) such as a metal, an alloy, an electrically conductive compound, or a mixture of them. As a specific example of the conductive material, there is indium oxide containing tungsten oxide (IWO), indium zinc oxide containing tungsten oxide (IWZO), indium oxide containing titanium oxide (ITiO), indium tin oxide containing titanium oxide (ITTiO), or the like. Needless to say, indium tin oxide (ITO), indium zinc oxide (IZO), indium tin oxide to which silicon oxide is added (ITSO), or the like can be used as well.

Exemplary composition ratios of the aforementioned conductive materials are described. The composition ratio of indium oxide containing tungsten oxide may be tungsten oxide of 1 wt % and indium oxide of 99 wt %. The composition ratio of indium zinc oxide containing tungsten oxide may be tungsten oxide of 1 wt %, zinc oxide of 0.5 wt %, and indium oxide of 98.5 wt %. The composition ratio of indium oxide containing titanium oxide may be titanium oxide of 1 to 5 wt % and indium oxide of 95 to 99 wt %. The composition ratio of indium tin oxide (ITO) may be tin oxide of 10 wt % and indium oxide of 90 wt %. The composition ratio of indium zinc oxide (IZO) may be zinc oxide of 10 wt % and indium oxide of 89 wt %. The composition ratio of indium tin oxide containing titanium oxide may be titanium oxide is 5 wt %, tin oxide is 10 wt %, and indium oxide is 85 wt %. The aforementioned composition ratios are just examples, and therefore, the composition ratios may be set as appropriate.

Next, an electroluminescent layer 1210 is formed by an evaporation method or an inkjet method. The electroluminescent layer 1210 contains an organic material or an inorganic material, and formed by combining an electron injection layer (EIL), an electron transporting layer (ETL), a light-emitting layer (EML), a hole transporting layer (HTL), a hole injection layer (HIL), or the like as appropriate. Note that the boundary between each layer is not necessarily clear, and there may be a case where a material forming each layer is partially mixed in each other, and the interface is unclear.

Note that the electroluminescent layer is preferably formed using multiple layers having different functions such as a hole injection-transporting layer, a light-emitting layer, and an electron injection-transporting layer.

Note also that the hole injection-transporting layer is preferably formed using a composite material of an organic compound material that has a hole transporting property and an inorganic compound material which shows an electron-accepting property to the organic compound material. By providing such a structure, a large number of hole carriers are generated in the organic compound that originally has few carriers, and thus extremely excellent hole injection-transporting properties can be obtained. With such an effect, a driving voltage can be lowered than the conventional one. Further, since the hole injection-transporting layer can be formed thick without increasing the driving voltage, short circuit of a light-emitting element resulting from dusts or the like can be suppressed.

As the organic compound material having a hole transporting property, there is copper phthalocyanine (abbreviation: CuPc); vanadyl phthalocyanine (abbreviation: VOPc); 4,4',4"-tris(N,N-diphenylamino)triphenylamine (abbreviation: TDATA); 4,4',4"-tris[N-(3-methylphenyl)-N-phenylamino]triphenylamine (abbreviation: MTDATA); 1,3,5-tris[N,N-di(m-tolyl)amino]benzene (abbreviation: m-MTDAB); N,N'-dipheny-N,N'-bis(3-methylphenyl)-1,1'-biphenyl-4,4'-diamine (abbreviation: TPD); 4,4'-bis[N-(1-napthyl)-N-phenylamino]biphenyl (abbreviation: NPB); 4,4'-bis{N-[4-di(m-tolyl)amino]phenyl-N-phenylamino}biphenyl (abbreviation: DNTPD); 4,4',4"-tris(N-carbazolyl)triphenylamine (abbreviation: TCTA); or the like. Note that the present invention is not limited to these.

As examples of the inorganic compound material having an electron-accepting property, titanium oxide, zirconium oxide, vanadium oxide, molybdenum oxide, tungsten oxide, rhenium oxide, ruthenium oxide, zinc oxide and the like can be given. In particular, vanadium oxide, molybdenum oxide, tungsten oxide, or rhenium oxide is preferably used since such materials can be easily evaporated in vacuum.

Note that the electron injection-transporting layer is formed using an organic compound material having an electron transporting property. Specifically, there are tris(8-quinolinolato)aluminum (abbreviation: $Alq_3$); tris(4-methyl- 8-quinolinolato)aluminum (abbreviation: $Almq_3$); bis(10-hydroxybenzo[h]quinolinato)beryllium (abbreviation: $BeBq_2$); bis(2-methyl-8-quinolinolato)(4-phenylphenolato) aluminum (abbreviation: BAlq); bis[2-(2'-hydroxyphenyl) benzoxazolato]zinc (abbreviation: $Zn(BOX)_2$); bis[2-(2'-hydroxyphenyl)benzothiazolato]zinc (abbreviation: $Zn(BTZ)_2$); bathophenanthroline (abbreviation: BPhen); bathocuproin (abbreviation: BCP); 2-(4-biphenylyl)-5-(4-tert-buthylphenyl)-1,3,4-oxadiazole (abbreviation: PBD); 1,3-bis[5-(4-tert-buthylphenyl)-1,3,4-oxadiazol-2-yl]benzene (abbreviation: OXD-7); 2,2',2"-(1,3,5-benzenetriyl)-tris(1-phenyl-1H-benzimidazole) (abbreviation: TPBI); 3-(4-biphenylyl)-4-phenyl-5-(4-tert-butylphenyl)-1,2,4-triazole (abbreviation: TAZ); 3-(4-biphenylyl)-4-(4-ethylphenyl)-5-(4-tert-butylphenyl)-1,2,4-triazole (abbreviation: p-EtTAZ); and the like. Note that the present invention is not limited to these.

The light-emitting layer can be formed using 9,10-di(2-naphthyl)anthracene (abbreviation: DNA); 9,10-di(2-naphthyl)-2-tert-butylanthracene (abbreviation: t-BuDNA); 4,4'-bis(2,2-diphenylvinyl)biphenyl (abbreviation: DPVBi); coumarin 30; coumarin 6; coumarin 545; coumarin 545T; perylene; rubrene; periflanthene; 2,5,8,11-tetra(tert-butyl) perylene (abbreviation: TBP); 9,10-diphenylanthracene (abbreviation: DPA); 5,12-diphenyltetracene (abbreviation: DPT); 4-(dicyanomethylene)-2-methyl-6-[p-(dimethylamino)styryl)-4H-pyran (abbreviation: DCM1); 4-(dicyanomethylene)-2-methyl-6-[2-julolidyl-9-yl)ethenyl]-4H-pyran (abbreviation: DCM2); 4-(dicyanomethylene)-2,6-bis[p-(dimethylamino)styryl]-4H-pyran (abbreviation: BisDCM); or the like. In addition, a compound capable of emitting phosphorescence can also be used, such as bis[2-(4',6'-difluorophenyl)pyridinato-N,$C^{2'}$]iridium(picolinate) (abbreviation: FIr(pic)); bis{2-[3',5'-bis(trifluorometyl)phenyl]pyridinato-N,$C^{2'}$}iridium(picolinate) (abbreviation: $Ir(CF_3\ ppy)_2(Pic)$); tris(2-phenylpyridinato-N,$C^{2'}$)iridium (abbreviation: $Ir(ppy)_3$); bis(2-phenylpyridinato-N,$C^{2'}$)iridium(acetylacetonate) (abbreviation: $Ir(ppy)_2(acac)$); bis[2-(2'-thienyl)pyridinato-N,$C^{3'}$]iridium(acetylacetonate) (abbreviation: $Ir(thp)_2(acac)$); bis(2-phenylquinolinato-N,$C^{2'}$)iridium (acetylacetonate) (abbreviation: $Ir(pq)_2(acac)$); or bis[2-(2'-benzothienyl)pyridinato-N,$C^{3'}$]iridium(acetylacetonate) (abbreviation: $Ir(btp)_2(acac)$).

Further, the light-emitting layer may be formed using a singlet excitation light-emitting material, and further, may be formed using a triplet excitation light-emitting material including a metal complex. For example, among light-emitting pixels for red emission, green emission and blue emission, the light-emitting pixel for red emission that has a relatively short luminance half decay period is formed using a triplet excitation light-emitting material while the other light-emitting pixels are formed using a singlet excitation light-emitting material. The triplet excitation light-emitting material has high luminous efficiency, which is advantageous in that lower power consumption is required for obtaining the same luminance. That is, when the triplet excitation light-emitting material is applied to the pixel for red emission, the amount of current flowing to the light-emitting element can be suppressed, resulting in the improved reliability. In view of power saving, the light-emitting pixels for red emission and green emission may be formed using a triplet excitation light-emitting material while the light-emitting element for blue emission may be formed using a singlet excitation light-emitting material. By forming the light-emitting element for green emission that is highly visible to human eyes using the triplet excitation light-emitting material, further lower power consumption can be achieved.

As a structure of the light-emitting layer, a light-emitting layer having a different emission spectrum may be formed in each pixel to perform color display. Typically, light-emitting layers corresponding to the respective colors of R (red), G (green) and B (blue) are formed. Also in this case, color purity can be improved or the mirror-like surface (glare) of the pixel portion can be prevented, by adopting a structure where a filter for transmitting light with the emission spectrum is provided on the emission side of the pixel. By providing the filter, a circularly polarizing plate or the like that has conventionally been required can be omitted, which can recover the loss of light emitted from the light-emitting layer. Further, changes in color tone, which are recognized when the pixel portion (display screen) is seen obliquely, can be reduced.

Further the light-emitting layer can be formed using an electroluminescent material of high molecular compounds such as polyparaphenylene vinylene, polyparaphenylene, polythiophene or polyfluorene.

An inorganic material may also be used for the light-emitting layer. As the inorganic material, a material in which manganese (Mn) or a rare earth element (such as Eu, Ce or the like) is added as an impurity into a compound semiconductor such as zinc sulfide (ZnS) can be used. The impurity like these is called a luminescent center ion, and electron transition in these ions can generate luminescence. In addition, into a compound semiconductor such as zinc sulfide (ZnS) or the like, Cu, Ag, Au or the like is added as an acceptor element and F, Cl, Br or the like is added as a donor element, and transition between the acceptor and the donor can generate luminescence. Further, in order to increase the luminous efficiency, GaAs may be added. The light-emitting layer may be formed to have a thickness of 100 to 1000 nm (preferably, 300 to 600 nm). Between the light-emitting layer like this and electrodes (anode and cathode), a dielectric layer is provided to increase the luminous efficiency. For the dielectric layer, barium titanate ($BaTiO_3$) or the like can be used. The dielectric layer may be 50 to 500 nm thick (preferably, 100 to 200 nm thick).

In any case, it is possible that the layer structure of the electroluminescent layer is changed, and there may be a case where a specific hole or electron injection-transporting layer or light-emitting layer is not provided, but instead, an alternative electrode layer which can achieve a similar function to such layers is provided, or a light-emitting material is dispersed in a layer as long as it can achieve the function of the light-emitting element.

In addition, a color filter (colored layer) may be formed over a sealing substrate. The color filter (colored layer) can be formed by an evaporation method or a droplet discharge method. By using the color filter (colored layer), high-resolution display can be performed. This is because the color filter (colored layer) can correct the broad peak of the emission spectrum of each RGB to be sharp.

In addition, by forming a light-emitting material with a single color and combining a color filter or a color conversion layer, full color display can be performed. The color filter (colored layer) or the color conversion layer may be formed over, for example, a second substrate (sealing substrate), and then attached to the base substrate.

Then, a counter electrode (also referred to as a second electrode) 1211 is formed by a sputtering method or an evaporation method. One of the pixel electrode 1209 and the counter electrode 1211 functions as an anode while the other functions as a cathode.

As a cathode material, a material having a low work function (3.8 eV or lower) is preferably used, such as metals, alloys, electrically conductive compounds, or a mixture of them. As a specific example of the cathode material, there are elements belonging to the group 1 or 2 of the periodic table, namely alkaline metals such as Li or Cs, alkaline earth metals such as Mg, Ca or Sr, alloys containing such metals (Mg:Ag or Al:Li), compounds containing such metals (LiF, CsF or $CaF_2$), or transition metals containing rare-earth metals. Note that since the cathode should transmit light, the aforementioned metals or alloys thereof are formed to be quite thin, and a metal (including an alloy) such as ITO is stacked thereover.

Then, a protective film formed of a silicon nitride film or a DLC (Diamond Like Carbon) film may be provided so as to cover the counter electrode 1211. Through the aforementioned steps, a light-emitting device of the present invention is completed.

This embodiment can be freely combined with any of the aforementioned embodiment mode and other embodiments.

Embodiment 4

Figure 7A:
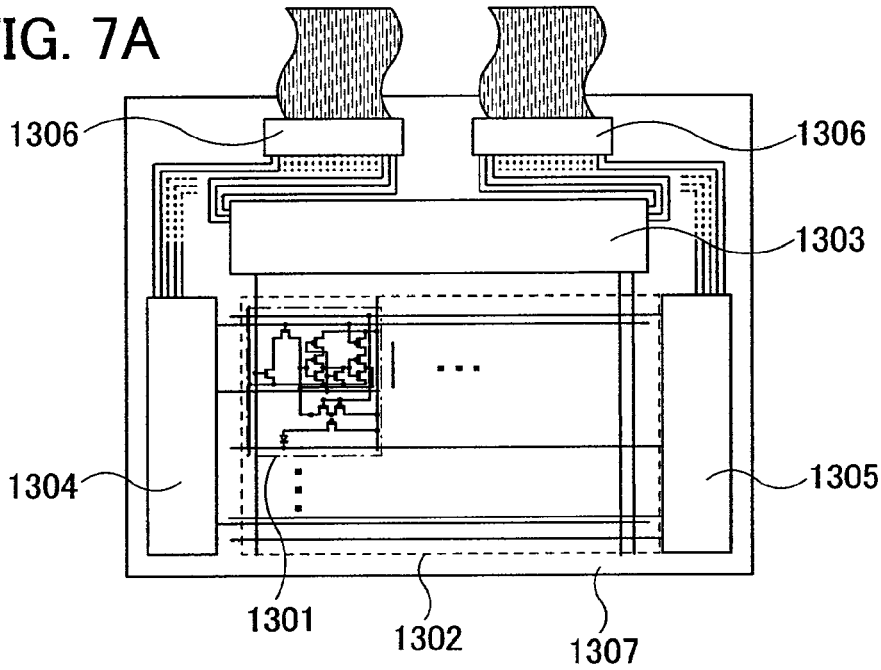
FIG. 7A is a top view showing a configuration in accordance with Embodiment 4 of the present invention.
Figure 7B:
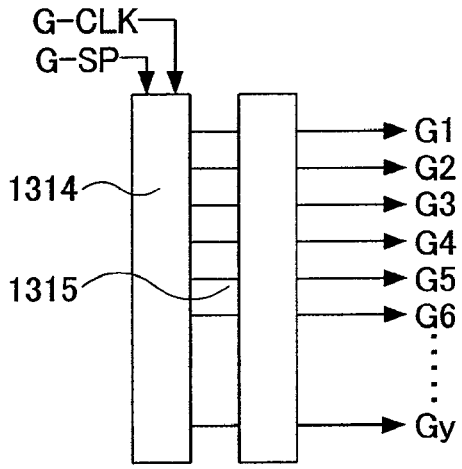
FIG. 7B and FIG. 7C are block diagrams thereof.
Figure 7C:
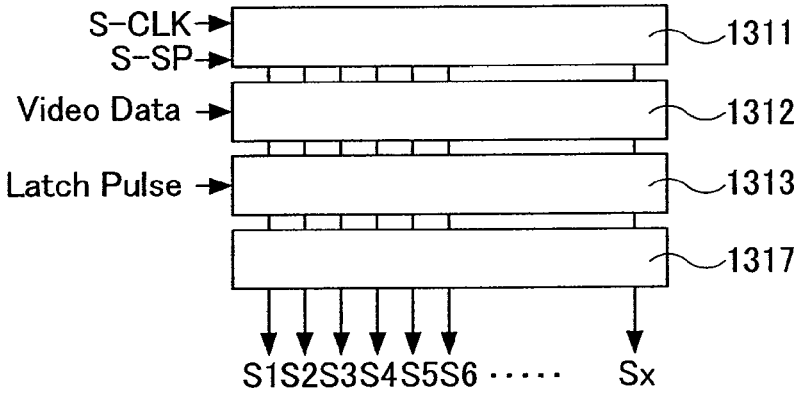

With reference to FIG. 7A to FIG. 7C, Embodiment 4 will describe a configuration of a display device.

In FIG. 7A, a pixel portion 1302 where a plurality of pixels 1301 are arranged in matrix is formed over a substrate 1307. At the periphery of the pixel portion 1302, a signal line drive circuit 1303, a first scan line driver circuit 1304, and a second scan line driver circuit 1305 are formed. The driver circuits are supplied with signals from outside through an FPC 1306.

FIG. 7B shows a configuration of the first scan line driver circuit 1304 and the second scan line driver circuit 1305. Each of the first scan line driver circuit 1304 and the second scan line driver circuit 1305 has a shift register 1314 and a buffer 1315. FIG. 7C shows a configuration of the signal line driver circuit 1303. The signal line driver circuit 1303 has a shift register 1311, a first latch circuit 1312, a second latch circuit 1313, and a buffer 1317.

Note that the configurations of the scan line driver circuits and the signal line driver circuit are not limited to the aforementioned ones, and for example, a sampling circuit, a level shifter or the like may be provided. In addition, a circuit such as a CPU, or a controller may be formed over the substrate 1307 together with the pixel portion 1302 in addition to the aforementioned driver circuits. Accordingly, the number of external circuits (ICs) to be connected can be reduced, and further reduction in weight and thickness can be achieved. Thus, the display device can be more effectively applied to a portable terminal or the like, in particular.

Note that in this specification, a display device such as a panel shown in FIG. 7A where an FPC is connected and an EL element is used for a light-emitting element is called an EL module.

This embodiment can be freely combined with any of the aforementioned embodiment mode and other embodiments.

Embodiment 5

Embodiment 5 will describe a method for correcting a potential of a second power source line in order to reduce influence of fluctuations of a current value of a light-emitting element that results from changes in the ambient temperature and with time.

A light-emitting element has a characteristic that a resistance value (internal resistance value) thereof changes in accordance with changes in the ambient temperature. Specifically, on the assumption that the room temperature is a normal temperature, the resistance value decreases when the ambient temperature becomes higher than the normal temperature, while it increases when the ambient temperature becomes lower than the normal temperature. Therefore, when the ambient temperature becomes higher, the amount of current increases and thus a higher luminance than a desired level of luminance is obtained. On the other hand, when the ambient temperature becomes lower, the amount of current decreases with the same voltage applied, and thus the luminance lower than a desired level of luminance is obtained. In addition, the light-emitting element has a characteristic that the current value flowing therein decreases along with degradation with time. Specifically, when the emission period and the non-emission period have accumulated, the resistance value of the light-emitting element increases along with degradation. Therefore, when the emission period and the non-emission period have accumulated, a current value flowing in the light-emitting element decreases with the same voltage applied as the initial emission period or non-emission period, and thus the luminance lower than a desired level of luminance is obtained.

Due to such characteristics of the light-emitting element, luminance varies when the ambient temperature changes or degradation is caused with time. In this embodiment, fluctuations of the amount of current in a light-emitting element that results from changes in the ambient temperature and degradation with time can be suppressed by performing corrections using a potential of a second power source line of the present invention.

Figure 8:
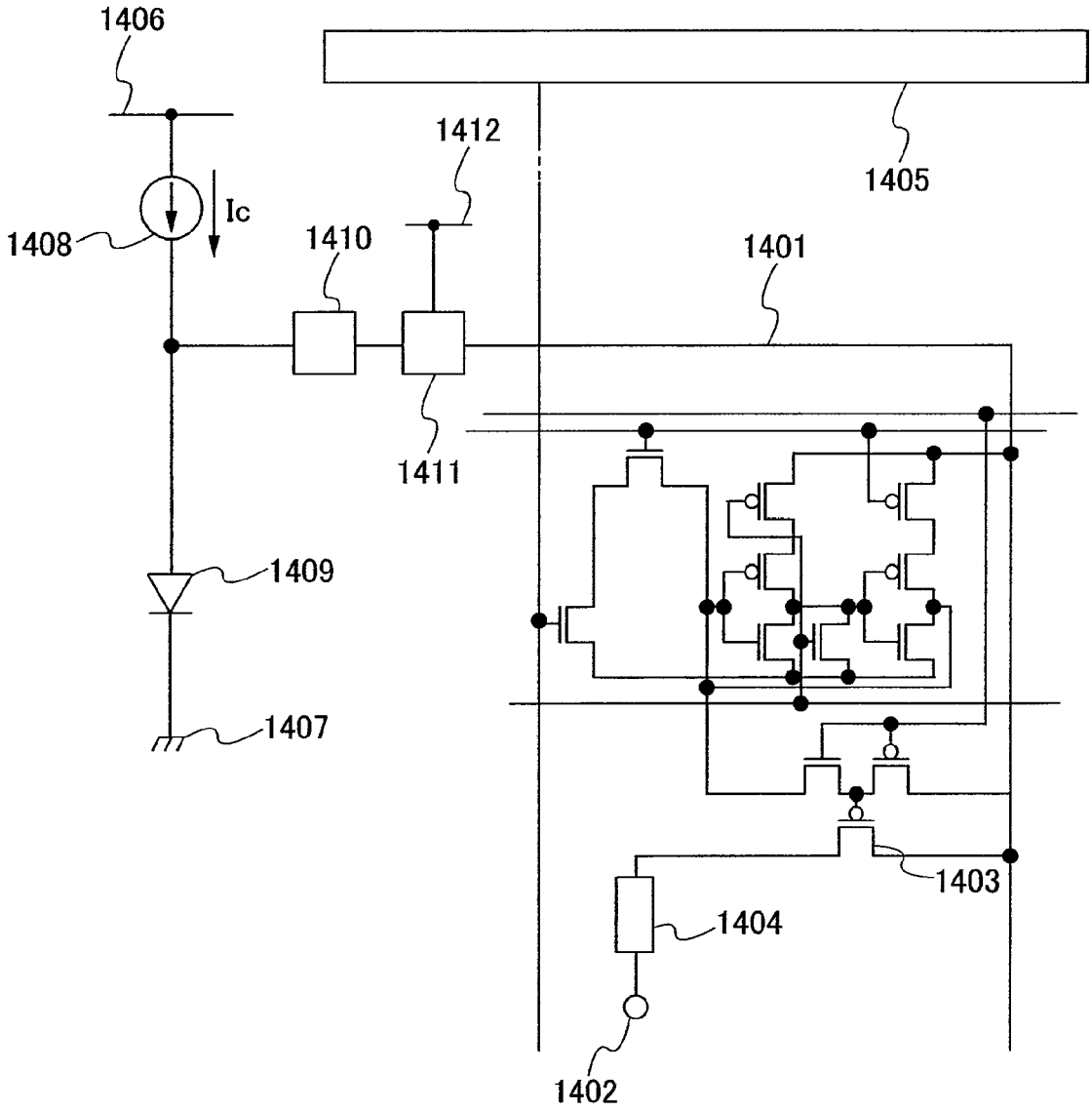
FIG. 8 shows a circuit diagram in accordance with Embodiment 5 of the present invention.

FIG. 8 shows a circuit configuration. The pixel shown in FIG. 8 has the same components as those in FIG. 3. Therefore, description on the same configuration as that of FIG. 3 is omitted here. In FIG. 8, a driving transistor 1403 and a light-emitting element 1404 are connected between a second power source line 1401 and a counter electrode 1402 shown in FIG. 3. A current flows from the second power source line 1401 to the counter electrode 1402. The light-emitting element 1404 emits light at a luminance corresponding to the amount of current flowing therein.

When potentials of the second power source line 1401 and the counter electrode 1402 are fixed in such a pixel configuration, the characteristics of the light-emitting element 1404 degrade when a current continuously flows into the light-emitting element 1404. In addition, the characteristics of the light-emitting element 1404 also change when the ambient temperature changes.

Specifically, when a current continuously flows into the light-emitting element 1404, the voltage-current characteristics thereof shift. That is, the resistance value of the light-emitting element 1404 increases, and the current value flowing therein decreases with the same voltage applied. In addition, even when the same amount of current flows into the light-emitting element 1404, the luminous efficiency decreases and the luminance becomes lower. As a temperature characteristic, the voltage-current characteristics of the light-emitting element 1404 shift when the ambient temperature becomes lower, and thus the resistance value of the light-emitting element 1404 increases.

By using a monitoring circuit, influence of fluctuation or deterioration as described above is corrected. In this embodiment, degradation of the light-emitting element 1404 or fluctuation due to temperature change is corrected by adjusting a potential of the second power source line 1401.

Thus, a configuration of a monitoring circuit is described. A monitoring current source 1408 and a monitoring light-emitting element 1409 are connected between a first monitoring power source 1406 and a second monitoring power source 1407. Between the monitoring light-emitting element 1409 and the monitoring current source 1408, an input terminal of a sampling circuit 1410 for outputting a voltage of the monitoring light-emitting element is connected. An output terminal of the sampling circuit 1410 is connected to a power source circuit 1411, and the second power source line 1401 is connected to the power source circuit 1411. Accordingly, a potential of the second power source line 1401 is controlled by the output of the sampling circuit 1410.

Next, operation of the monitoring circuit is described. First, in the case where the light-emitting element 1404 is controlled to emit light corresponding to the highest gray scale, the monitoring current source 1408 supplies a desired amount of current to the light-emitting element 1404. The amount of current at this time is indicated by Imax.

Then, a voltage necessary for flowing the current of Imax is applied to both electrodes of the monitoring light-emitting element 1409. Even if the voltage-current characteristics of the monitoring light-emitting element 1409 change with time or changes in the ambient temperature, a voltage applied to the both electrodes of the monitoring light-emitting element 1409 changes accordingly to have an optimal value. Therefore, the influence of changes (time, changes in the ambient temperature, or the like) of the monitoring light-emitting element 1409 can be corrected.

A voltage applied to the monitoring light-emitting element 1409 is input to the input terminal of the sampling circuit 1410. The output potential of the sampling circuit 1410 is connected to the power source circuit 1411 connected to a power source line 1412 for the power source circuit.

The power source circuit 1411 supplies a potential in accordance with the potential from the output terminal of the sampling circuit 1410 to the second power source line 1401. That is, the potential of the second power source line 1401 is corrected by the monitoring circuit, and thus, degradation or fluctuation in accordance with changes in the ambient temperature, of the light-emitting element 1404 is corrected.

Note that the sampling circuit 1410 may be a circuit capable of sampling and holding a voltage in accordance with a current input to the monitoring light-emitting element. For example, an input voltage may be sampled by using a switching element such as a MOS transistor or the like, and a capacitor element.

The power source circuit 1411 may be a circuit capable of outputting an input voltage. For example, the power source circuit 1411 may be constructed from an operational amplifier, a bipolar transistor or a MOS transistor, or a combination of these.

Note that the monitoring light-emitting element 1409 is preferably formed over the same substrate as, by the same manufacturing method as, and at the same time as the light-emitting element 1404 in the pixel. This is because if there is a difference in characteristics between the monitoring light-emitting element and the light-emitting element in the pixel, accurate correction cannot be carried out.

Note that there arise many periods when current is not supplied to the light-emitting element 1404 in the pixel; therefore, the monitoring light-emitting element 1409 degrades at faster speed if a current is continuously supplied to the monitoring light-emitting element 1409. Therefore, a potential output from the sampling circuit 1410 corresponds to a potential to which high degree of correction is applied. Thus, the correction may be carried out in accordance with the actual degradation level of the light-emitting element in the pixel. For example, if the average emission rate of the whole pixels is 30%, current may be supplied to the monitoring light-emitting element 1409 only in the period corresponding to 30% of the luminance. At this time, there arises a period when no current is supplied to the monitoring light-emitting element 1409; however, voltage should be continuously supplied from the output terminal of the sampling circuit 1410. In order to realize this, a capacitor element may be connected to the input terminal of the sampling circuit 1410 so as to hold a potential of the time when current has been supplied to the monitoring light-emitting element 1409.

Note that when the monitoring circuit is operated in accordance with the highest gray scale, a potential that is subjected to high degree of correction is output, which can make a screen burn in the pixels (luminance unevenness due to variations of degradation levels among pixels) less noticeable. Therefore, the monitoring circuit is preferably operated in accordance with the highest gray scale.

In this embodiment, it is further preferable to operate the driving transistor 1403 in the linear region. By operating the driving transistor 1403 in the linear region, it can operate as a switch. Therefore, influence of the characteristic fluctuation of the driving transistor 1403 due to degradation or changes in the ambient temperature can be lessened. In the case of operating the driving transistor 1403 only in the linear region, current supply to the light-emitting element 1404 is often controlled digitally. In such a case, it is preferable to combine a time gray scale method, an area gray scale method and/or the like in order to achieve multi-gray scale display.

This embodiment can be freely combined with any of the aforementioned embodiment mode and other embodiments.

Embodiment 6

As an electronic device having the semiconductor device of the present invention, there are television receivers, cameras such as video cameras or digital cameras), goggle type displays, navigation system, audio reproducing devices (e.g., car audio component sets), computers, game machines, portable information terminals (e.g., mobile computers, portable phones, portable game machines or electronic books), image reproducing devices provided with a recording medium (specifically, devices for reproducing a recording medium such as a digital versatile disc (DVD) and having a display portion for displaying the reproduced image), and the like. Specific examples of such electronic devices are shown in FIG. 9, FIG. 10, FIG. 11A, FIG. 11B, FIG. 12A, FIG. 12B, FIG. 13, and FIG. 14A to FIG. 14E.

Figure 9:
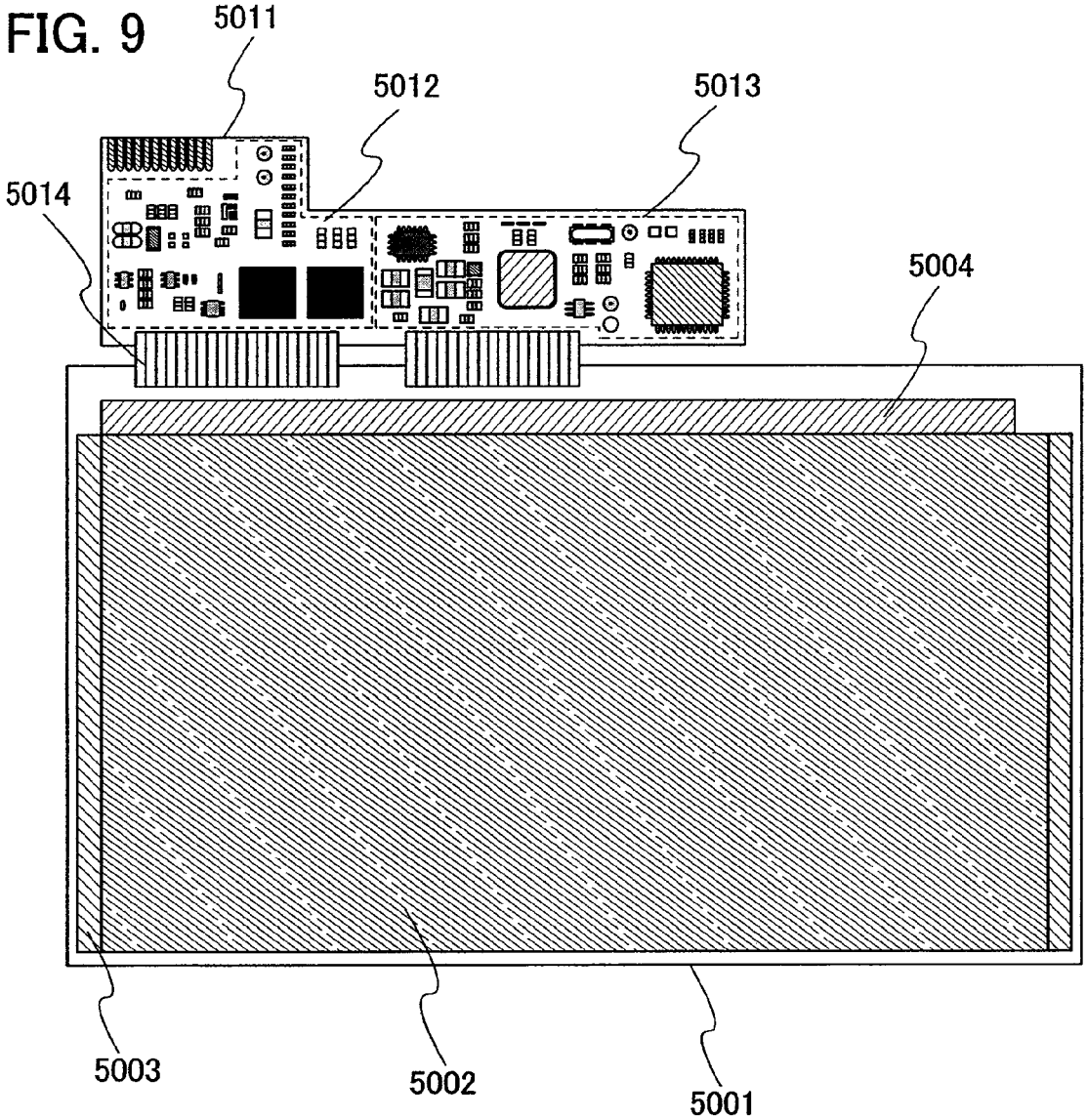
FIG. 9 shows an electronic device in accordance with Embodiment 6 of the present invention.

FIG. 9 shows an EL module constructed by combining a display panel 5001 and a circuit board 5011. Over the circuit board 5011, a control circuit 5012, a signal dividing circuit 5013 and/or the like are formed, which are electrically connected to the display panel 5001 through a connecting wiring 5014.

The display panel 5001 has a pixel portion 5002 where plural pixels are provided, a scan line driver circuit 5003, and a signal line driver circuit 5004 for supplying a video signal to a selected pixel. Note that in the case of manufacturing an EL module, the semiconductor device that constitutes a part of a pixel in the pixel portion 5002 may be manufactured according to the aforementioned embodiments. In addition, a control driver circuit portion such as the scan line driver circuit 5003, or the signal line driver circuit 5004 can be manufactured by using TFTs formed according to the aforementioned embodiments. In this manner, an EL module television shown in FIG. 9 can be completed.

Figure 10:
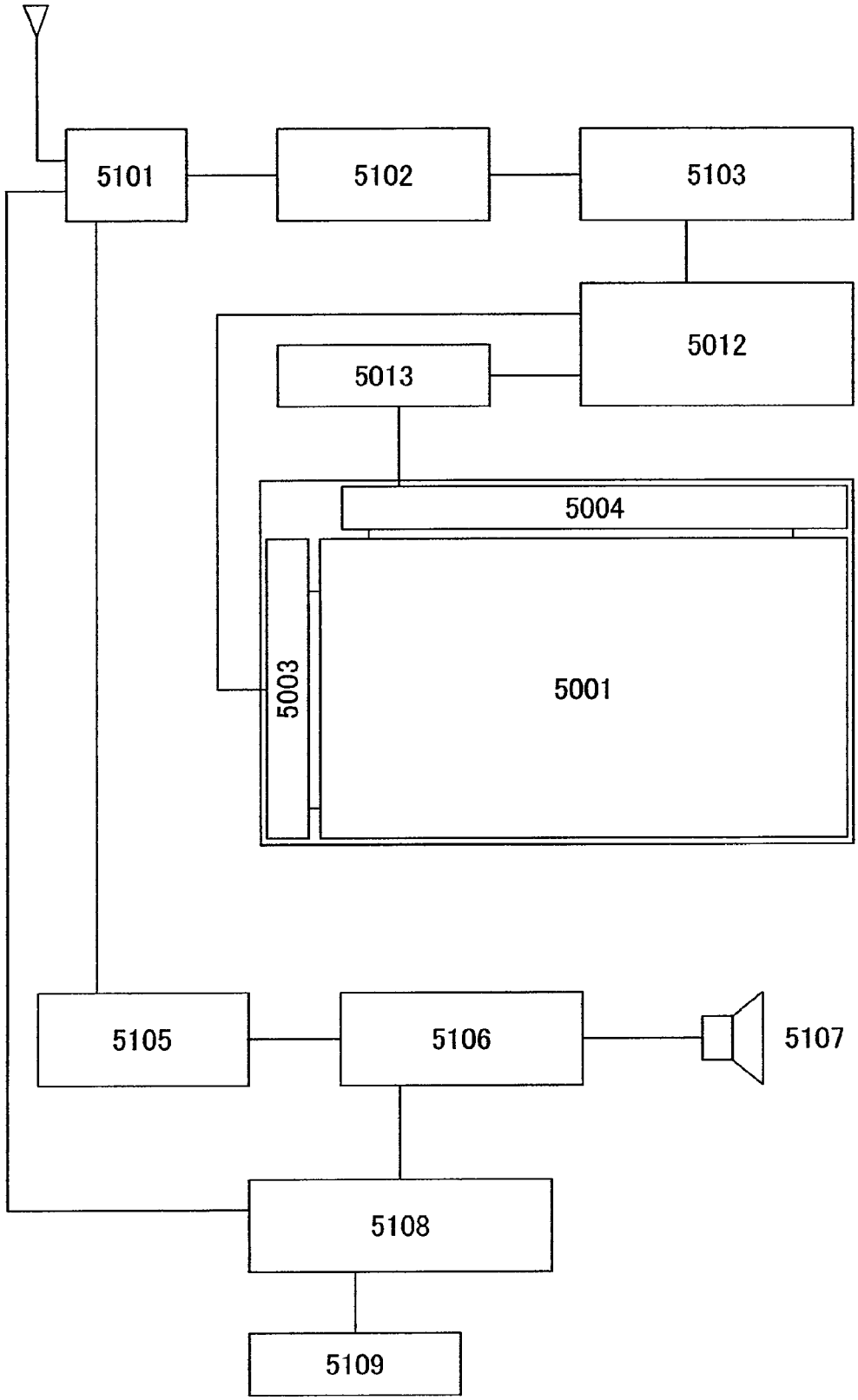
FIG. 10 shows an electronic device in accordance with Embodiment 6 of the present invention.

FIG. 10 is a block diagram showing the main configuration of an EL television receiver. A tuner 5101 receives a video signal and an audio signal. The video signal is processed by a video signal amplifying circuit 5102, a video signal processing circuit 5103 for converting an output signal from the video signal amplifying circuit 5102 to a color signal corresponding to each color of red, green and blue, and the control circuit 5012 for converting the video signal to be input into a driver IC. The control circuit 5012 outputs a signal to each of a scan line side and a signal line side. In the case of digital drive, the signal dividing circuit 5013 may be provided on the signal line side so that the input digital signal is divided into m signals to be supplied.

Of the signals received by the tuner 5101, an audio signal is transmitted to the audio signal amplifying circuit 5105, and an output thereof is supplied to a speaker 5107 through an audio signal processing circuit 5106. A control circuit 5108 receives control data on the receiving station (receive frequency) and volume from an input portion 5109, and transmits the signal to the tuner 5101 and the audio signal processing circuit 5106.

Figure 11A:
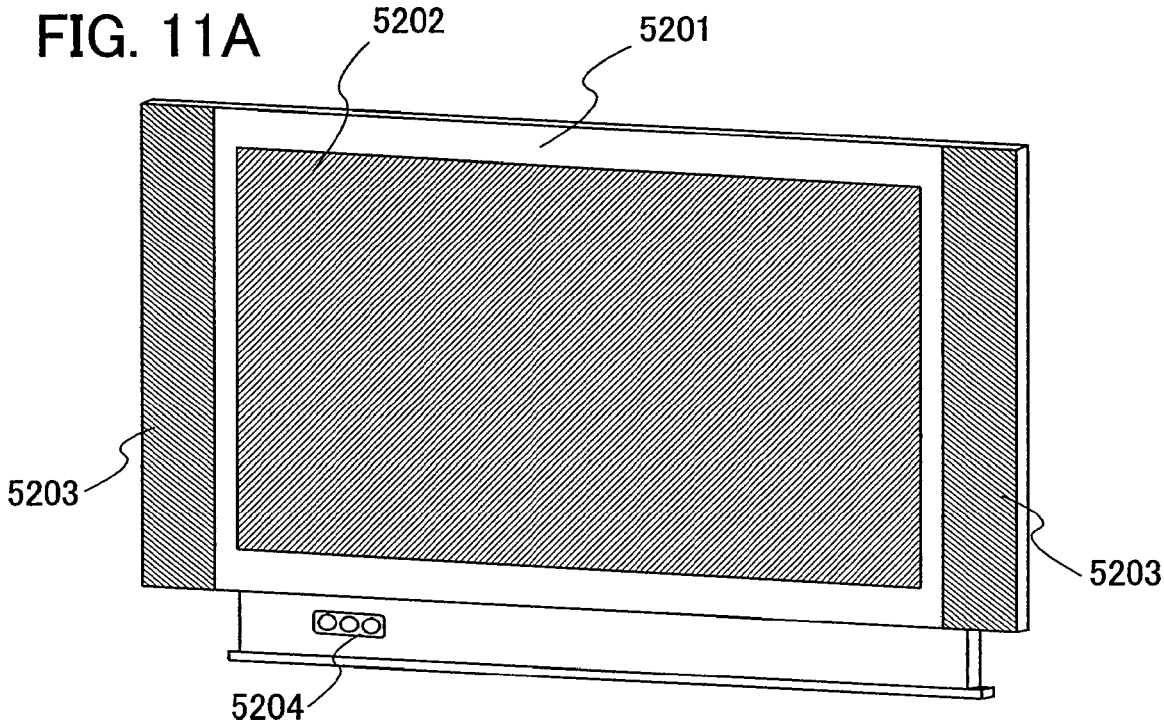
FIG. 11A and FIG. 11B each show an electronic device in accordance with Embodiment 6 of the present invention.

As shown in FIG. 11A, a television receiver can be completed by incorporating an EL module into a housing 5201. A display screen 5202 is formed using the EL module. In addition, speakers 5203, an operating switch 5204 and/or the like are appropriately provided.

Figure 11B:
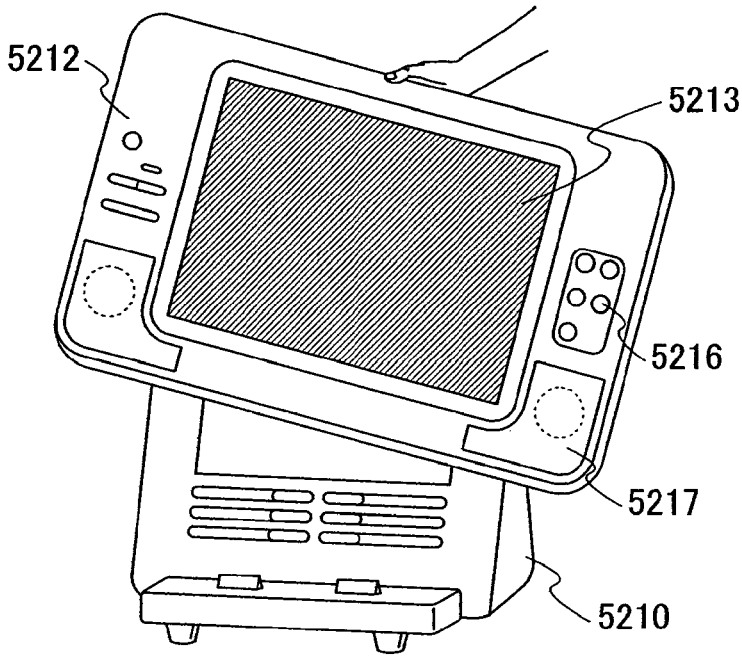

FIG. 11B shows a television receiver, only a display of which is wireless and portable. A housing 5212 incorporates a battery and a signal receiver, and the battery drives a display portion 5213 and a speaker portion 5217. The battery can be repeatedly charged with a battery charger 5210. In addition, the battery charger 5210 can transmit and receive a video signal, and transmit the video signal to the signal receiver of the display. The housing 5212 is controlled with an operating key 5216. The device shown in FIG. 11B can also transmit a signal from the housing 5212 to the battery charger 5210 by operating the operating key 5216; therefore, it can also be called a video-audio two-way communication device. In addition, the device can also perform communication control of another electronic device by operating the operating key 5216 to transmit signals from the housing 5212 to the battery charger 5210 and further by controlling the above another electronic device to receive a signal which the battery charger 5210 can transmit; therefore, the device can also be called a general-purpose remote control device. The present invention can be applied to the display portion 5213.

By applying the semiconductor device of the present invention to the television receivers shown in FIG. 9, FIG. 10, FIG. 11A and FIG. 11B, a constant potential is continuously supplied to a gate terminal of a driving transistor regardless of whether a light-emitting element in a pixel of a display portion is in the emission state or non-emission state. Therefore, products with more stable operation can be manufactured as compared to the conventional pixel configuration where a potential is held in a storage capacitor, and thus less defective products can be provided to customers.

Further, by applying the semiconductor device of the present invention to the television receivers shown in FIG. 9, FIG. 10, FIG. 11A and FIG. 11B, in a pixel of the display portion, an on or off potential applied to a gate terminal of a driving transistor can be set separately from a potential of a data line. Accordingly, the potential amplitude of the data line can be set small, and a semiconductor device with significantly suppressed power consumption can be provided. Thus, products with significantly suppressed power consumption can be provided to customers.

Needless to say, the present invention is not limited to such television receivers, and can be applied to various objects as a large-area advertising display medium, for example, an information display board at the train station or airport, an advertising display board on the street and the like, in addition to a monitor of a personal computer.

Figure 12A:
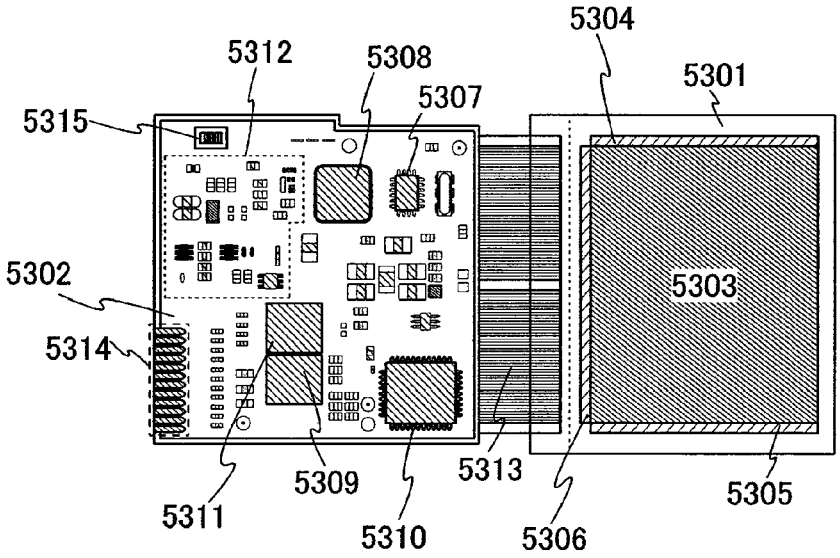
FIG. 12A and FIG. 12B show an electronic device in accordance with Embodiment 6 of the present invention.

FIG. 12A shows a module constructed by combining a display panel 5301 and a printed wiring board 5302. The display panel 5301 has a pixel portion 5303 where plural pixels 5303 are provided, a first scan line driver circuit 5304, a second scan line driver circuit 5305, and a signal line driver circuit 5306 for supplying a video signal to a selected pixel.

The printed wiring board 5302 is provided with a controller 5307, a central processing unit (CPU) 5308, a memory 5309, a power source circuit 5310, an audio processing circuit 5311, a transmission-reception circuit 5312 or the like. The printed wiring board 5302 and the display panel 5301 are connected through a flexible printed wiring board (FPC) 5313. The flexible printed wiring board 5313 may be provided with a capacitor element, a buffer circuit, or the like in order to prevent noise interruption on the power source voltage or signals and also prevent dull signal rising. In addition, the controller 5307, the audio processing circuit 5311, the memory 5309, the CPU 5308, the power source circuit 5310 and/or the like can be mounted on the display panel 5301 by COG (Chip On Glass) bonding. By the COG bonding, a scale of the printed wiring board 5302 can be reduced.

Various control signals are input and output through an interface portion 5314 provided on the printed wiring board 5302. In addition, an antenna port 5315 for transmitting a signal to and receiving a signal from an antenna is provided on the printed wiring board 5302.

Figure 12B:
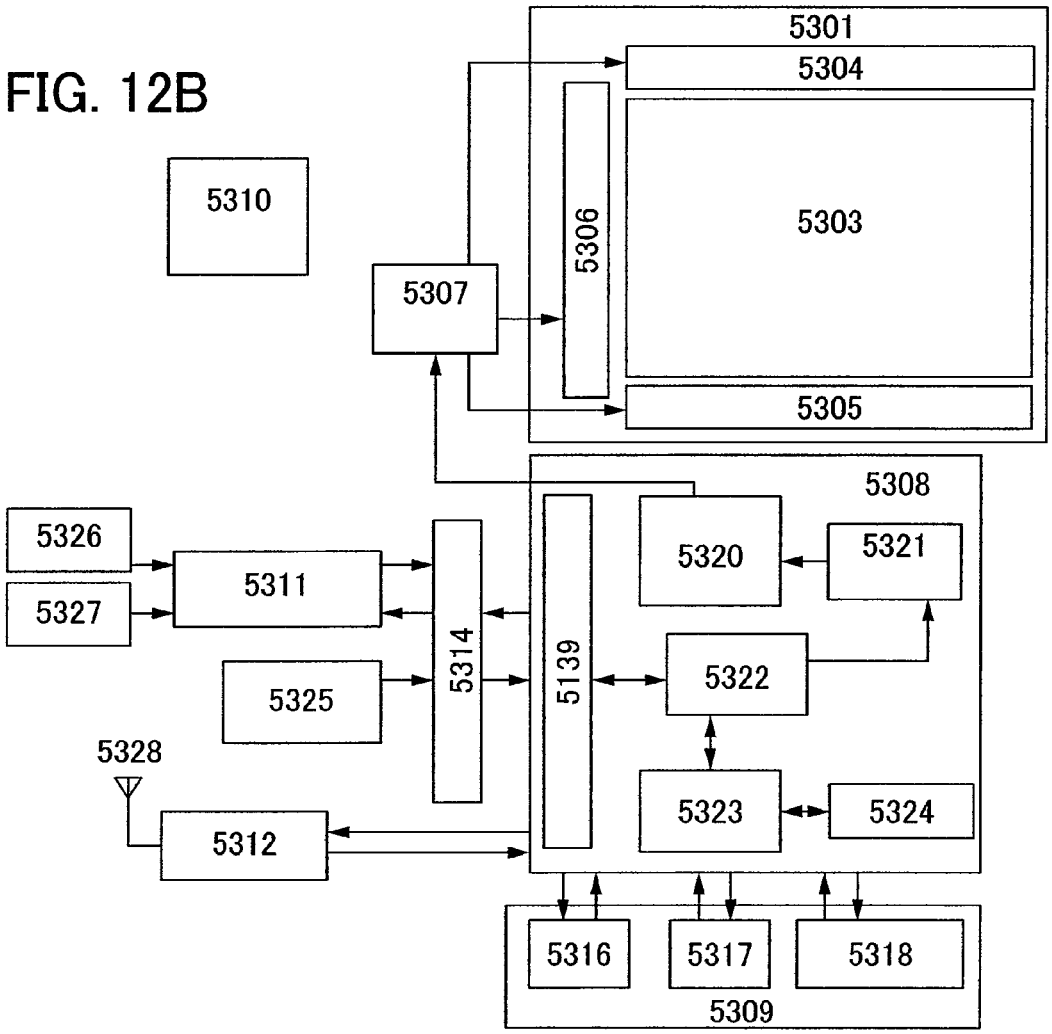

FIG. 12B is a block diagram of the module shown in FIG. 12A. This module includes a VRAM 5316, a DRAM 5317, a flash memory 5318 or the like as the memory 5309. The VRAM 5316 stores image data to be displayed on the panel, the DRAM 5317 stores video data or audio data, and the flash memory 5318 stores various programs.

The power source circuit 5310 supplies power to operate the display panel 5301, the controller 5307, the CPU 5308, the audio processing circuit 5311, the memory 5309 and the transmission-reception circuit 5312. Based on the specification of the panel, the power source circuit 5310 may be provided with a current source.

The CPU 5308 includes a control signal generation circuit 5320, a decoder 5321, a register 5322, an arithmetic circuit 5323, a RAM 5324, an I/F 5319 for the CPU 5308 or the like. Various signals input to the CPU 5308 through the I/F 5319 are once stored in the register 5322 before input to the arithmetic circuit 5323, the decoder 5321 or the like. The arithmetic circuit 5323 performs operation based on the input signals, and specifies an address for sending various instructions. On the other hand, the input signal to the decoder 5321 is decoded and input to the control signal generation circuit 5320. The control signal generation circuit 5320 generates signals containing various instructions based on the input signals and transmits them to addresses specified in the arithmetic circuit 5323, specifically such as the memory 5309, the transmission-reception circuit 5312, the audio processing circuit 5311, the controller 5307 or the like.

The memory 5309, the transmission-reception circuit 5312, the audio processing circuit 5311, and the controller 5307 operate in accordance with the instruction each of which has received. The operation is described briefly below.

A signal input from an input means 5325 is transmitted to the CPU 5308 mounted on the printed wiring board 5302 through the interface portion 5314. The control signal generation circuit 5320 converts image data stored in the VRAM 5316 into a predetermined format in accordance with the signal transmitted from the input means 5325 such as a pointing device or a keyboard, and then transmits the data to the controller 5307.

The controller 5307 processes the signal containing image data that is transmitted from the CPU 5308 in accordance with the specification of the panel, and then supplies the data to the display panel 5301. In addition, the controller 5307 generates a Hsync signal, a Vsync signal, a clock signal CLK, AC voltage (AC Cont), and a switching signal I/R based on the power source voltage input from the power source circuit 5310 or the various signals input from the CPU 5308, and supplies them to the display panel 5301.

The transmission-reception circuit 5312 processes a signal that has been transmitted and received as an electromagnetic wave at an antenna 5328, and specifically includes high frequency circuits such as an isolator, a bandpass filter, a VCO (Voltage Controlled Oscillator), an LPF (Low Pass Filter), a coupler and/or a balun. Of signals transmitted from or received to the transmission-reception circuit 5312, a signal containing audio data are transmitted to the audio processing circuit 5311 in accordance with the instruction from the CPU 5308.

The signal containing audio data that is transmitted in accordance with the instruction from the CPU 5308 is demodulated into an audio signal in the audio processing circuit 5311 and then transmitted to a speaker 5327. An audio signal transmitted from a microphone 5326 is modulated in the audio processing circuit 5311, and then transmitted to the transmission-reception circuit 5312 in accordance with the instruction from the CPU 5308.

The controller 5307, the CPU 5308, the power source circuit 5310, the audio processing circuit 5311, and the memory 5309 can be integrated as a package of this embodiment. This embodiment can be applied to any circuits, except such high frequency circuits as an isolator, a bandpass filter, a VCO (Voltage Controlled Oscillator), a LPF (Low Pass Filter), a coupler or a balun.

Figure 13:
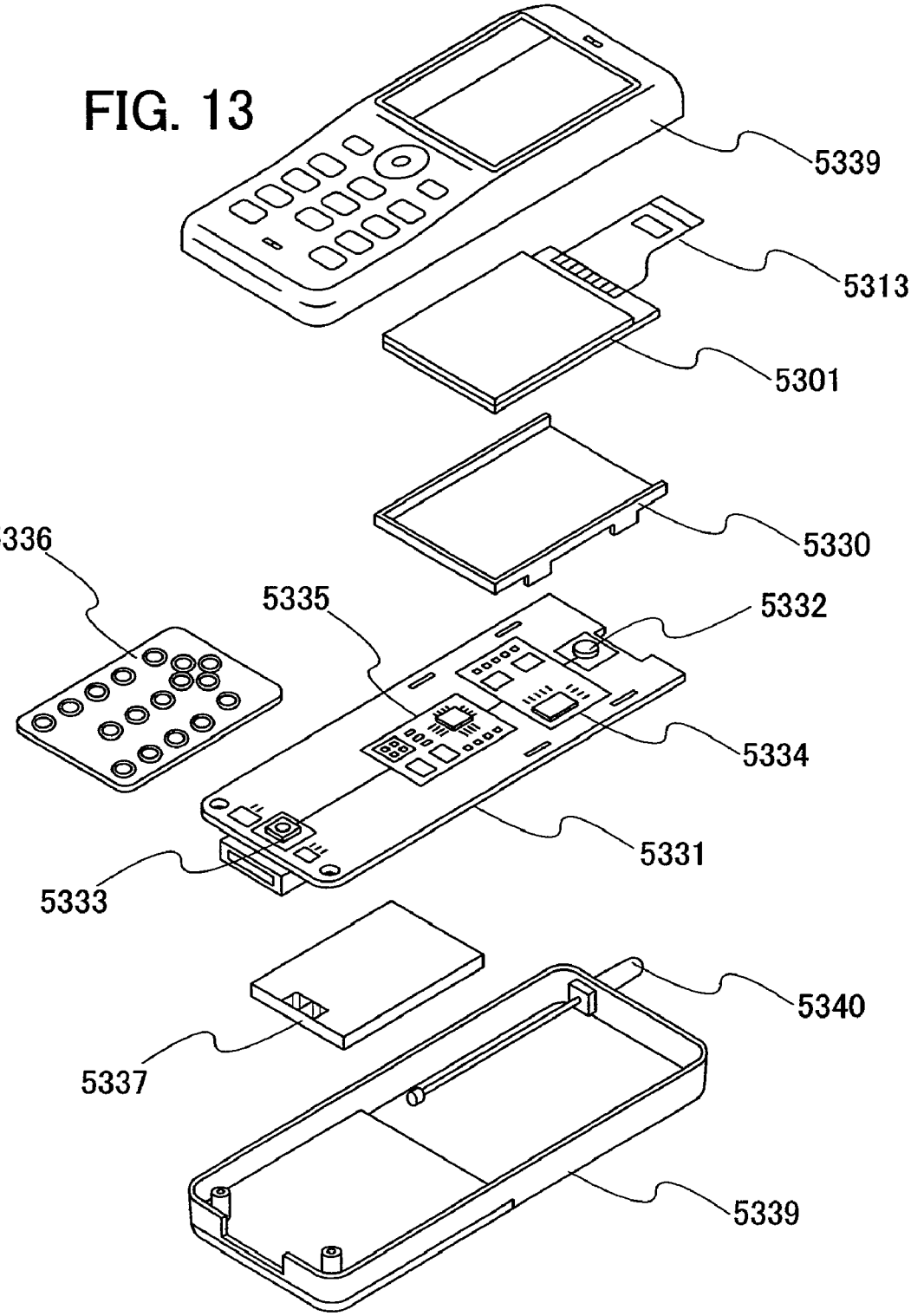
FIG. 13 shows an electronic device in accordance with Embodiment 6 of the present invention.

FIG. 13 shows one mode of a portable phone including the module shown in FIG. 12A and FIG. 12B. The display panel 5301 can be incorporated into a housing 5330 in an attachable-detachable manner The shape and size of the housing 5330 can be changed in accordance with the size of the display panel 5301 as appropriate. The housing 5330 to which the display panel 5301 is fixed is fit into a printed board 5331 so as to be assembled as a module.

The display panel 5301 is connected to the printed board 5331 through an FPC 5313. On the printed board 5331, a speaker 5332, a microphone 5333, a transmission-reception circuit 5334, and a signal processing circuit 5335 including a CPU, a controller and/or the like are formed. Such module is combined with an input means 5336, a battery 5337 and an antenna 5340, and then incorporated into housings 5339. A pixel portion of the display panel 5301 is disposed so that it can be seen from an open window formed in the housing 5339.

The portable phone in accordance with this embodiment can be changed into various modes in accordance with the function or applications. For example, multiple display panels may be provided and the housing may be appropriately divided into pliral units so as to enable the portable phone to be folded and unfolded with a hinge.

In the portable phone in FIG. 13, the display panel 5301 includes a matrix arrangement of the semiconductor devices described in embodiment mode. In the semiconductor device, on or off potential applied to a gate terminal of a driving transistor can be set separately from a potential of a data line in a pixel, and a constant potential can be continuously supplied to the gate terminal of the driving transistor regardless of whether a light-emitting element in the pixel is in the emission state or non-emission state. Accordingly, the potential amplitude of the data line can be set small to reduce power consumption, and more stable operation can be performed as compared to the conventional pixel configuration where a potential is held in a storage capacitor element. Since the display panel 5301 constructed of such a semiconductor device has a similar characteristic, the portable phone can achieve low power consumption and stable display operation. With such characteristics, the power source circuits can be significantly reduced in number or scale and defective display can be reduced; therefore, reduction in size and weight of the housing 5339 can be achieved. Since the portable phone in accordance with the present invention can achieve reduction in power consumption and weight, products with improved portability can be provided to customers.

Figure 14A:
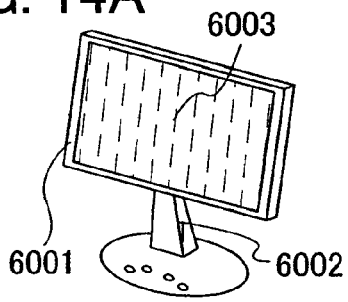
FIG. 14A to FIG. 14E each show an electronic device in accordance with Embodiment 6 of the present invention.

FIG. 14A is a television set including a housing 6001, a support base 6002, a display portion 6003 and the like. In this television set, the display portion 6003 includes a matrix arrangement of the semiconductor devices described in embodiment mode. In the semiconductor device, an on or off potential applied to a gate electrode of a driving transistor can be set separately from a potential of a data line in a pixel, and a constant potential can be continuously supplied to the gate terminal of the driving transistor regardless of whether a light-emitting element in the pixel is in the emission state or non-emission state. Accordingly, the potential amplitude of the data line can be set small to reduce power consumption, and more stable operation can be performed as compared to the conventional pixel configuration where a potential is held in a storage capacitor. Since the display portion 6003 constructed of such a semiconductor device has a similar characteristic, the television set can achieve low power consumption and stable display operation. With such characteristics, the power source circuits can be significantly reduced in number or scale and defective display can be reduced in the television set; therefore, reduction in size and weight of the housing 6001 can be achieved. Since the television set in accordance with the present invention can achieve reduction in power consumption and weight, products with improved portability can be provided to customers.

Figure 14B:
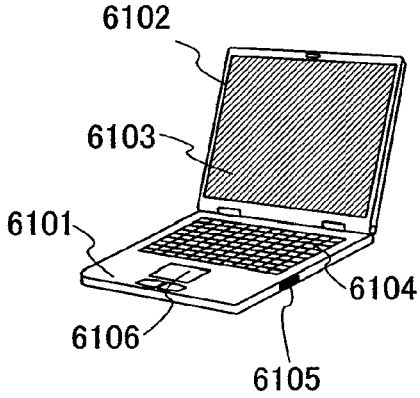

FIG. 14B is a computer including a main body 6101, a housing 6102, a display portion 6103, a keyboard 6104, an external connecting port 6105, a pointing mouse 6106 and the like. In this computer, the display portion 6103 includes a matrix arrangement of the semiconductor devices described in embodiment mode. In the semiconductor device, an on or off potential applied to a gate electrode of a driving transistor can be set separately from a potential of a data line, and a constant potential can be continuously supplied to the gate terminal of the driving transistor regardless of whether a light-emitting element in the pixel is in the emission state or non-emission state. Accordingly, the potential amplitude of the data line can be set small to reduce power consumption, and more stable operation can be performed as compared to the conventional pixel configuration where a potential is held in a storage capacitor. Since the display portion 6103 constructed of such a semiconductor device has a similar characteristic, the computer can achieve low power consumption and stable display operation. With such characteristics, the power source circuits can be significantly reduced in number or scale and defective display can be reduced; therefore, reduction in size and weight of the main body 6101 and the housing 6102 can be achieved. Since the computer in accordance with the present invention can achieve reduction in power consumption and weight, products with improved portability can be provided to customers.

Figure 14C:
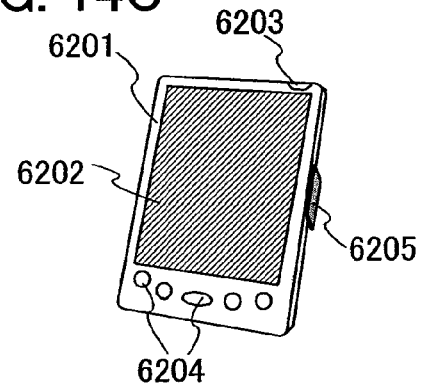

FIG. 14C is a portable computer including a main body 6201, a display portion 6202, a switch 6203, operating keys 6204, an IR port 6205 and the like. In this portable computer, the display portion 6202 includes a matrix arrangement of the semiconductor devices described in embodiment mode. In the semiconductor device, an on or off potential applied to a gate electrode of a driving transistor can be set separately from a potential of a data line, and a constant potential can be continuously supplied to the gate terminal of the driving transistor regardless of whether a light-emitting element in a pixel is in the emission state or non-emission state. Accordingly, the potential amplitude of the data line can be set small to reduce power consumption, and more stable operation can be performed as compared to the conventional pixel configuration where a potential is held in a storage capacitoL Since the display portion 6202 constructed of such a semiconductor device has a similar characteristic, the portable computer can achieve low power consumption and stable display operation. With such characteristics, the power source circuits can be significantly reduced in number or scale and defective display can be reduced; therefore, reduction in size and weight of the main body 6201 can be achieved. Since the portable computer in accordance with the present invention can achieve reduction in power consumption and weight, products with improved portability can be provided to customers.

Figure 14D:
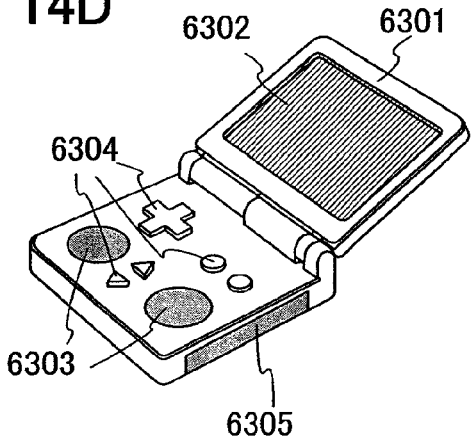

FIG. 14D is a portable game machine including a housing 6301, a display portion 6302, speaker portions 6303, operating keys 6304, a recording-medium insert socket 6305 and the like. In this portable game machine, the display portion 6302 includes a matrix arrangement of the semiconductor devices described in embodiment mode. In the semiconductor device, an on or off potential applied to a gate electrode of a driving transistor can be set separately from a potential of a data line, and a constant potential can be continuously supplied to the gate terminal of the driving transistor regardless of whether a light-emitting element in a pixel is in the emission state or non-emission state. Accordingly, the potential amplitude of the data line can be set small to reduce power consumption, and more stable operation can be performed as compared to the conventional pixel configuration where a potential is held in a storage capacitor. Since the display portion 6302 constructed of such a semiconductor device has a similar characteristic, the portable game machine can achieve low power consumption and stable display operation. With such characteristics, the power source circuits can be significantly reduced in number or scale and defective display can be reduced; therefore, reduction in size and weight of the housing 6301 can be achieved. Since the portable gate machine in accordance with the present invention can achieve reduction in power consumption and weight, products with improved portability can be provided to customers.

Figure 14E:
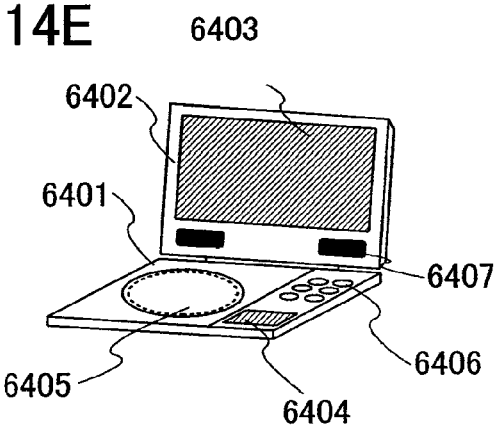
Figure 15:
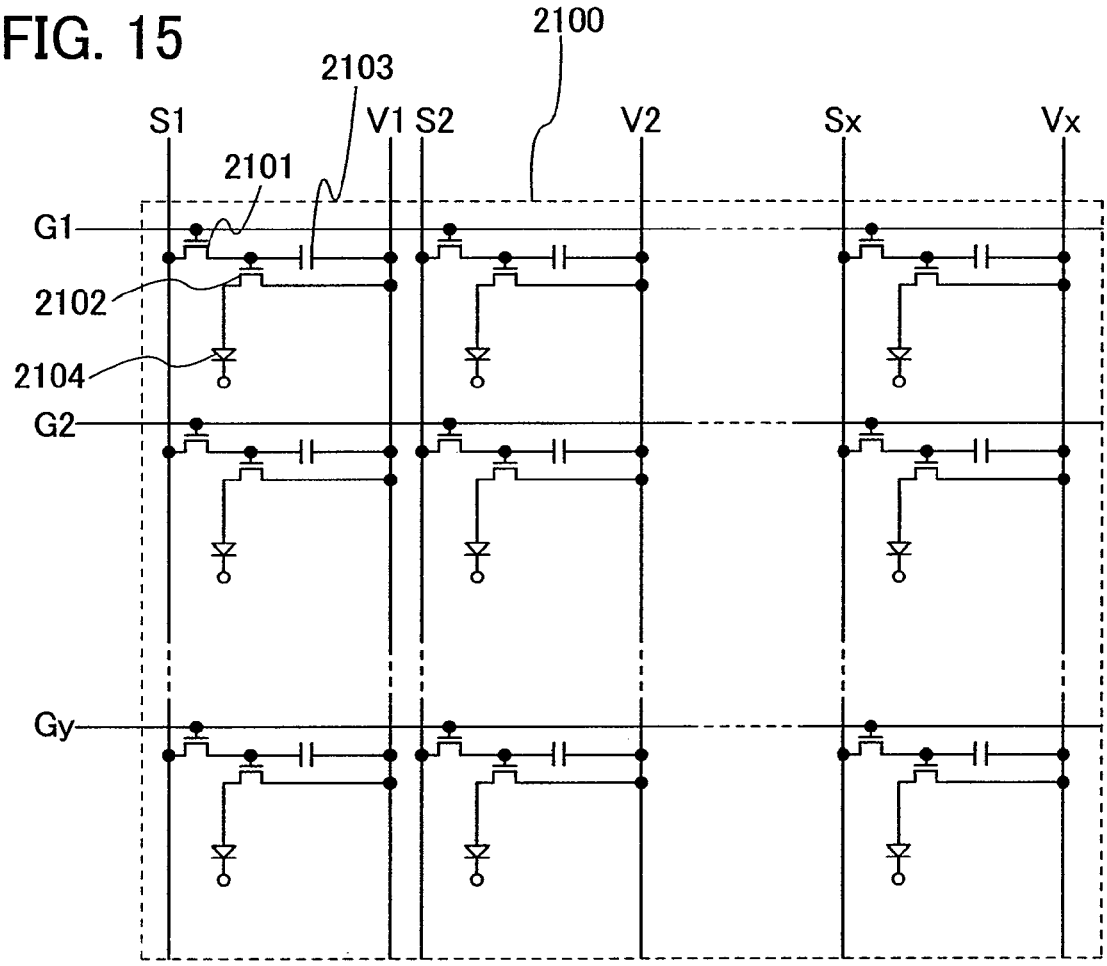
FIG. 15 shows a conventional pixel configuration.
Figure 16A:
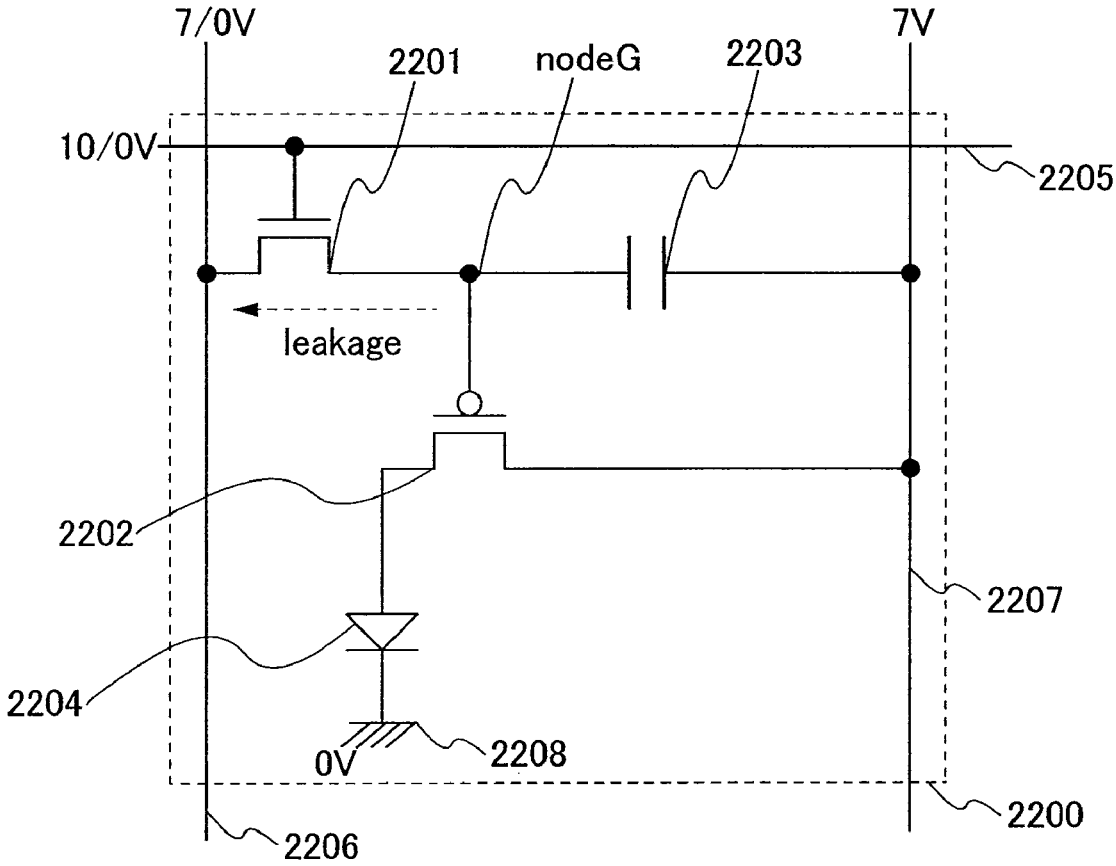
FIG. 16A and FIG. 16B show problems in a conventional pixel configuration.
Figure 16B:
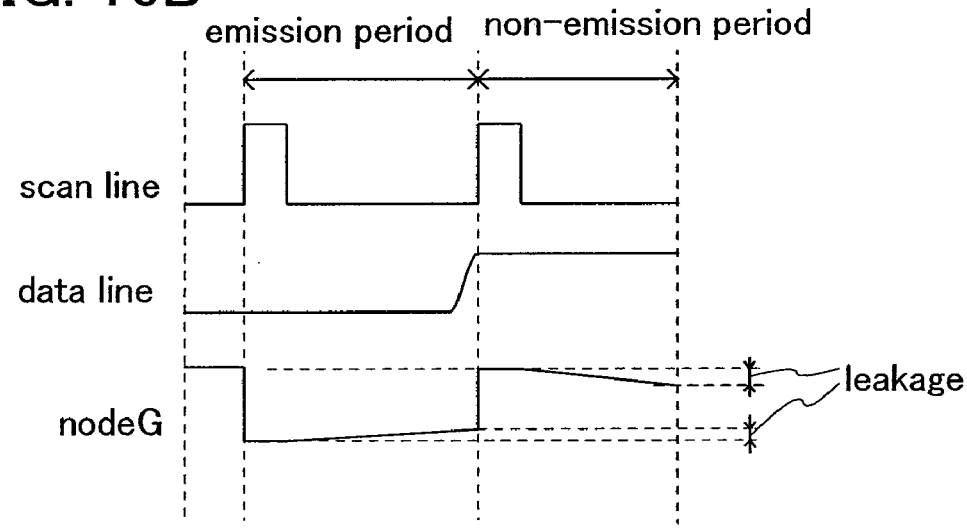

FIG. 14E is a portable image reproducing device provided with a recording medium (specifically, a DVD player) including a main body 6401, a housing 6402, a display portion A 6403, a display portion B 6404, a recording medium (e.g., a DVD) reading portion 6405, an operating key 6406, a speaker portion 6407 and the like. The display portion A 6403 mainly displays image data, and the display portion B 6404 mainly displays text data. In this portable image reproducing device, each of the display portion A 6403 and the display portion B 6404 includes a matrix arrangement of the semiconductor devices described in embodiment mode. In the semiconductor device, an on off potential applied to a gate electrode of a driving transistor can be set separately from a potential of a data line in a pixel, and a constant potential can be continuously supplied to the gate terminal of the driving transistor regardless of whether a light-emitting element in a pixel is in the emission state or non-emission state. Accordingly, the potential amplitude of the data line can be set small to reduce power consumption, and more stable operation can be performed as compared to the conventional pixel configuration where a potential is held in a storage capacitor Since the display portion A 6403 and the display portion B 6404 each constructed of such a semiconductor device has a similar characteristic, the portable image reproducing device can achieve low power consumption and stable display operation. With such characteristics, the power source circuits can be significantly reduced in number or scale and defective display can be reduced; therefore, reduction in size and weight of the main body 6401 and the housing 6402 can be achieved. Since the portable image reproducing device in accordance with the present invention can achieve reduction in power consumption and weight, products with improved portability can be provided to customers.

Display devices used in such electronic devices can be formed using not only a glass substrate but also a heat-resistant plastic substrate in accordance with size, strength or applications. Accordingly, even more reduction in weight can be achieved.

Note that in each display portion used for the aforementioned electronic devices, a semiconductor device shown in embodiment mode is provided. Therefore, if a signal supply is stopped to a memory circuit in each pixel of a pixel portion from a scan line driver circuit and a data line driver circuit which are disposed at the periphery of the pixel portion, signal data immediately before stopping the signal supply can be held in the memory circuit, and thus the light-emitting element can keep the emission state or non-emission state. Therefore, neither the scan line driver circuit nor the data line driver circuit should be operated for displaying a still image or the like by using the semiconductor device of the present invention, and thus significant reduction of such electronic devices of the present invention in power consumption can be expected. Accordingly, products with reduced power consumption also in displaying still images can be provided to customers.

Note that examples shown in this embodiment are only exemplary, and therefore, the present invention is not limited to such applications.

This embodiment can be freely combined with any of the aforementioned embodiment mode and other embodiments.

The present application is based on Japanese Patent application No. 2006-001929 filed on Jan. 7, 2006 in the Japanese Patent Office, the entire contents of which are hereby incorporated by reference.

What is claimed is:

1. A semiconductor device comprising:

a data line;

first to third scan lines;

first and second power source lines;

a light-emitting element;

a first transistor of which a gate terminal is connected to the data line, and a first terminal is connected to the first power source line;

a second transistor of which a gate terminal is connected to the first scan line, and a first terminal is connected to a second terminal of the first transistor;

a memory circuit;

a switching circuit; and a third transistor of which a gate terminal is connected to the switching circuit, and a second terminal is connected to the light-emitting element, wherein the memory circuit is connected to a second terminal of the second transistor and the second scan line, wherein the switching circuit is connected to the second terminal of the second transistor, the memory circuit, and the third scan line, and wherein the switching circuit conducts switching between the third transistor, and the memory circuit and the second power source line, and applies an input potential to the gate terminal of the third transistor.

2. The semiconductor device according to claim 1, wherein the first and second transistors comprise N-channel transistors and the third transistor comprises a P-channel transistor.

3. The semiconductor device according to claim 1, wherein a potential of the first power source line is lower than a potential of the second power source line.

4. The semiconductor device according to claim 1, wherein the light-emitting element comprises an electroluminescent element.

5. A semiconductor device comprising:

a data line;

first to third scan lines;

first and second power source lines;

a light-emitting element;

a first N-channel transistor of which a gate terminal is connected to the data line, and a first terminal is connected to the first power source line;

a second N-channel transistor of which a gate terminal is connected to the first scan line, and a first terminal is connected to a second terminal of the first N-channel transistor;

a memory circuit;

a switching circuit; and a first P-channel transistor of which a first terminal is connected to the second power source line and a second terminal is connected to the light-emitting element, wherein the memory circuit comprises:

a NOR circuit of which a first input terminal is connected to a second terminal of the second N-channel transistor, and a second input terminal is connected to the second scan line;

a third N-channel transistor of which a gate terminal is connected to an output terminal of the NOR circuit, and a first terminal is connected to the first power source line;

a second P-channel transistor of which a gate terminal is connected to the first scan line and a first terminal is connected to the second power source line; and a third P-channel transistor of which a gate terminal is connected to the output terminal of the NOR circuit, a first terminal is connected to a second terminal of the second P-channel transistor, and a second terminal is connected to a second terminal of the third N-channel transistor, wherein the switching circuit comprises:

a fourth N-channel transistor of which a gate terminal is connected to the third scan line, a first terminal is connected to a second terminal of the second N-channel transistor, a second terminal of the third N-channel transistor, and a second terminal of the third P-channel transistor, and a second terminal is connected to a gate terminal of the first P-channel transistor; and a fourth P-channel transistor of which a gate terminal is connected to the third scan line, a first terminal is connected to the second power source line, and a second terminal is connected to a second terminal of the fourth N-channel transistor, and a gate terminal of the first P-channel transistor, wherein a first potential for turning on the first P-channel transistor or a second potential for turning off the first P-channel transistor is input to the memory circuit, wherein a third potential for turning off the first P-channel transistor is input to the second power source line, and wherein the switching circuit supplies one of the first potential, the second potential, and the third potential to the gate terminal of the first P-channel transistor.

6. The semiconductor device according to claim 5, wherein a potential of the first power source line is lower than a potential of the second power source line.

7. The semiconductor device according to claim 5, wherein the light-emitting element comprises an electroluminescent element.

8. A display device having a semiconductor device, comprising a display portion including a plurality of pixels and a driver circuit; the pixel comprising:

a data line;

first to third scan lines;

first and second power source lines;

a light-emitting element;

a first transistor of which a gate terminal is connected to the data line, and a first terminal is connected to the first power source line;

a second transistor of which a gate terminal is connected to the first scan line, and a first terminal is connected to a second terminal of the first transistor;

a memory circuit;

a switching circuit; and a third transistor of which a gate terminal is connected to the switching circuit, and a second terminal is connected to the light-emitting element, wherein the memory circuit is connected to a second terminal of the second transistor and the second scan line, wherein the switching circuit is connected to the second terminal of the second transistor, the memory circuit, and the third scan line, and wherein the switching circuit conducts switching between the third transistor, and the memory circuit and the second power source line, and applies an input potential to the gate terminal of the third transistor.

9. The display device according to claim 8, wherein the first and second transistors comprise N-channel transistors and the third transistor comprises a P-channel transistor.

10. The display device according to claim 8, wherein a potential of the first power source line is lower than a potential of the second power source line.

11. The display device according to claim 8, wherein the light-emitting element comprises an electroluminescent element.

12. A display device having a semiconductor device, comprising a display portion including a plurality of pixels and a driver circuit; the pixel comprising:

a data line;

first to third scan lines;

first and second power source lines;

a light-emitting element;

a first N-channel transistor of which a gate terminal is connected to the data line, and a first terminal is connected to the first power source line;

a second N-channel transistor of which a gate terminal is connected to the first scan line, and a first terminal is connected to a second terminal of the first N-channel transistor;

a memory circuit;

a switching circuit; and a first P-channel transistor of which a first terminal is connected to the second power source line and a second terminal is connected to the light-emitting element, wherein the memory circuit comprises:

a NOR circuit of which a first input terminal is connected to a second terminal of the second N-channel transistor, and a second input terminal is connected to the second scan line;

a third N-channel transistor of which a gate terminal is connected to an output terminal of the NOR circuit, and a first terminal is connected to the first power source line;

a second P-channel transistor of which a gate terminal is connected to the first scan line and a first terminal is connected to the second power source line; and a third P-channel transistor of which a gate terminal is connected to the output terminal of the NOR circuit, a first terminal is connected to a second terminal of the second P-channel transistor, and a second terminal is connected to a second terminal of the third N-channel transistor, wherein the switching circuit comprises:

a fourth N-channel transistor of which a gate terminal is connected to the third scan line, a first terminal is connected to a second terminal of the second N-channel transistor, a second terminal of the third N-channel transistor, and a second terminal of the third P-channel transistor, and a second terminal is connected to a gate terminal of the first P-channel transistor; and a fourth P-channel transistor of which a gate terminal is connected to the third scan line, a first terminal is connected to the second power source line, and a second terminal is connected to a second terminal of the fourth N-channel transistor, and a gate terminal of the first P-channel transistor, wherein a first potential for turning on the first P-channel transistor or a second potential for turning off the first P-channel transistor is input to the memory circuit, wherein a third potential for turning off the first P-channel transistor is input to the second power source line, and wherein the switching circuit supplies one of the first potential, the second potential, and the third potential to the gate terminal of the first P-channel transistor.

13. The display device according to claim 12, wherein a potential of the first power source line is lower than a potential of the second power source line.

14. The display device according to claim 12, wherein the light-emitting element comprises an electroluminescent element.

15. An electronic device including a display panel having a semiconductor device, comprising a display portion including a plurality of pixels and a driver circuit; the pixel comprising:

a data line;

first to third scan lines;

first and second power source lines;

a light-emitting element;

a first transistor of which a gate terminal is connected to the data line, and a first terminal is connected to the first power source line;

a second transistor of which a gate terminal is connected to the first scan line, and a first terminal is connected to a second terminal of the first transistor;

a memory circuit;

a switching circuit; and a third transistor of which a gate terminal is connected to the switching circuit, and a second terminal is connected to the light-emitting element, wherein the memory circuit is connected to a second terminal of the second transistor and the second scan line, wherein the switching circuit is connected to the second terminal of the second transistor, the memory circuit, and the third scan line, and wherein the switching circuit conducts switching between the third transistor, and the memory circuit and the second power source line, and applies an input potential to the gate terminal of the third transistor.

16. The electronic device according to claim 15, wherein the first and second transistors comprise N-channel transistors and the third transistor comprises a P-channel transistor.

17. The electronic device according to claim 15, wherein a potential of the first power source line is lower than a potential of the second power source line.

18. The electronic device according to claim 15, wherein the light-emitting element comprises an electroluminescent element.

19. An electronic device including a display panel having a semiconductor device, comprising a display portion including a plurality of pixels and a driver circuit; the pixel comprising:

a data line;

first to third scan lines;

first and second power source lines;

a light-emitting element;

a first N-channel transistor of which a gate terminal is connected to the data line, and a first terminal is connected to the first power source line;

a second N-channel transistor of which a gate terminal is connected to the first scan line, and a first terminal is connected to a second terminal of the first N-channel transistor;

a memory circuit;

a switching circuit; and a first P-channel transistor of which a first terminal is connected to the second power source line and a second terminal is connected to the light-emitting element, wherein the memory circuit comprises:

a NOR circuit of which a first input terminal is connected to a second terminal of the second N-channel transistor, and a second input terminal is connected to the second scan line;

a third N-channel transistor of which a gate terminal is connected to an output terminal of the NOR circuit, and a first terminal is connected to the first power source line;

a second P-channel transistor of which a gate terminal is connected to the first scan line and a first terminal is connected to the second power source line; and a third P-channel transistor of which a gate terminal is connected to the output terminal of the NOR circuit, a first terminal is connected to a second terminal of the second P-channel transistor, and a second terminal is connected a second terminal of the third N-channel transistor, wherein the switching circuit comprises:

a fourth N-channel transistor of which a gate terminal is connected to the third scan line, a first terminal is connected to a second terminal of the second N-channel transistor, a second terminal of the third N-channel transistor, and a second terminal of the third P-channel transistor, and a second terminal is connected to a gate terminal of the first P-channel transistor; and a fourth P-channel transistor of which a gate terminal is connected to the third scan line, a first terminal is connected to the second power source line, and a second terminal is connected to a second terminal of the fourth N-channel transistor, and a gate terminal of the first P-channel transistor, wherein a first potential for turning on the first P-channel transistor or a second potential for turning off the first P-channel transistor is input to the memory circuit, wherein a third potential for turning off the first P-channel transistor is input to the second power source line, and wherein the switching circuit supplies one of the first potential, the second potential, and the third potential to the gate terminal of the first P-channel transistor.

20. The electronic device according to claim 19, wherein a potential of the first power source line is lower than a potential of the second power source line.

21. The electronic device according to claim 19, wherein the light-emitting element comprises an electroluminescent element.

22. The electronic device according to claim 19, wherein the electronic device is at least one of the group consisting of television receivers, cameras, goggle type displays, navigation system, audio reproducing devices, computers, game machines, portable information terminals, and image reproducing devices provided with a recording medium.

* * * * *